US008777487B2

(12) United States Patent
Liao et al.

(10) Patent No.: US 8,777,487 B2
(45) **Date of Patent: *Jul. 15, 2014**

(54) AIR EVACUABLE STORAGE BAG WITH MULTIPLE AIR EXIT HOLES

(75) Inventors: Chieh Hua Liao, Sindian (TW); Yaw Shin Liao, Sindian (TW); Kao Hsiung Liao, Sindian (TW)

(73) Assignee: Chieh Hua LIAO, Sindian, Taipei County (TW)

( * ) Notice: Subject to any disclaimer, the term of this patent is extended or adjusted under 35 U.S.C. 154(b) by 1137 days.

This patent is subject to a terminal disclaimer.

(21) Appl. No.: 12/192,787

(22) Filed: Aug. 15, 2008

(65) Prior Publication Data

US 2009/0238497 A1 Sep. 24, 2009

(30) Foreign Application Priority Data

Mar. 21, 2008 (TW) ..... 97110263 A
Apr. 3, 2008 (TW) ..... 97112402 A

(51) Int. Cl.

| | |
|---|---|
| ***B65D 33/01*** | (2006.01) |
| ***B65D 81/20*** | (2006.01) |
| ***B65D 85/18*** | (2006.01) |
| ***B65D 33/25*** | (2006.01) |

(52) U.S. Cl.

CPC ..... *B65D 33/01* (2013.01); *B65D 81/2023* (2013.01); *B65D 85/18* (2013.01); *B65D 33/2591* (2013.01)

USPC ..... 383/103; 383/43

(58) Field of Classification Search

USPC ..... 383/102; 156/147

See application file for complete search history.

(56) References Cited

U.S. PATENT DOCUMENTS

| | | | | |
|---|---|---|---|---|
| 3,873,735 | A * | 3/1975 | Chalin et al. | 426/87 |
| 3,958,391 | A | 5/1976 | Kujubu | |
| 3,989,182 | A * | 11/1976 | Stearley | 383/45 |
| 4,953,550 | A * | 9/1990 | Dunshee | 607/114 |
| 6,116,781 | A | 9/2000 | Skeens | |
| 6,357,915 | B2 | 3/2002 | Anderson | |
| 6,692,147 | B2 * | 2/2004 | Nelson | 383/63 |
| 6,729,473 | B2 | 5/2004 | Anderson | |
| 2009/0239006 | A1 * | 9/2009 | Liao et al. | 428/34.1 |

FOREIGN PATENT DOCUMENTS

| | | | | |
|---|---|---|---|---|
| CN | 2324103 | Y | 6/1999 | |
| CN | 01144648 | | 8/2002 | |
| JP | 08230898 | A | 10/1996 | |
| JP | 10024968 | A * | 1/1998 | B65D 81/26 |

(Continued)

*Primary Examiner* — Gary Elkins
*Assistant Examiner* — Christopher Demeree
(74) *Attorney, Agent, or Firm* — Rabin & Berdo, P.C.

(57) ABSTRACT

An air-evacuable storage bag with multiple air exit holes includes two sheets of outer film, two sheets of inner film, a crosswise hot sealing line formed by hot-sealing the two sheets of outer film and the two sheets of inner film, a storage space used for accepting an article, and an air exhaust area; the two sheets of outer film includes a first end and a middle end; the two sheets of inner film are placed in between the two sheets of outer film; the storage space is formed between the crosswise hot sealing line and the first end; the air exhaust area is formed between the crosswise hot sealing line and a top end of the two sheets of outer film; a plurality of air outlets are formed intermittently between the two sheets of inner film at the crosswise hot sealing line; the air outlets can be opened automatically.

6 Claims, 19 Drawing Sheets

(56) References Cited

FOREIGN PATENT DOCUMENTS

| | | | | | |
|---|---|---|---|---|---|
| JP | 10310151 | A | * | 11/1998 | ..... B65D 33/01 |
| JP | 2005-126091 | A | | 5/2005 | |
| JP | 2007326646 | A | * | 12/2007 | |
| KR | 200398096 | Y | | 10/2005 | |
| KR | 1020070090758 | A | | 9/2007 | |
| TW | 150635 | | | 1/1991 | |
| TW | M264234 | Y | | 5/2005 | |
| TW | M321892 | | | 11/2007 | |

* cited by examiner

AIR EVACUABLE STORAGE BAG WITH MULTIPLE AIR EXIT HOLES

CROSS-REFERENCES TO RELATED APPLICATIONS

This non-provisional application claims priority under 35 U.S.C. §119(a) on Patent Application No. 97110263 filed in Taiwan, R.O.C. on Mar. 21, 2008 and Patent Application No. 97112402 filed in Taiwan, R.O.C. on Apr. 3, 2008, the entire contents of which are hereby incorporated by reference.

FIELD OF THE INVENTION

The present invention relates to a storage bag, and more particularly to an air-evacuable storage bag with multiple air exit holes.

BACKGROUND

In a monsoon area, the wet and highly changeable climate causes an article to be dampened and damaged easily, suffering mildew, discoloration, off-flavor, etc. For this reason, a storage bag with three sealed faces and one opened face is commonly used for storing or packing an article. A user must still use their hands to squeeze air out of the storage bag and then seal the storage bag after packing an article in it n order to ensure the stored object is damp-proof.

A storage bag in common use places an exhaust passageway on one side of the bag, one end including an air inlet and another end including an air outlet. When the user squeezes the bag with their hands, air flows from the air inlet into the exhaust passageway, passes through the exhaust passageway and is then expelled out of the air outlet. Examples of such bags are Chinese Patent Application No. 01144648.X entitled "compressing storage bag", U.S. Pat. No. 6,116,781 entitled "storage bag with one-way air valve", U.S. Pat. No. 6,357,915 entitled "storage bag with one-way air valve" and U.S. Pat. No. 6,729,473 entitled "air-evacuable bag with double-layered valve film and method for manufacturing same". However, bags of this design are very time and labor consuming; air exhaust is unable to be processed and the air exhaust effect is not good if the air outlet is blocked by an article; air is liable to stay in the side areas of the air exhaust passageway and is unable to be expelled. Moreover, the air outlet must be large enough to allow air to be expelled, or it will cause air to flow back to the storage bag along the air exhaust passageway. In addition, the shared air exhaust passageway is unable to stop air from flowing back such that air sealing is insufficient, so that it is not possible to achieve smooth air expulsion and long air locking time after the air has been expelled.

SUMMARY OF THE INVENTION

The present invention is proposed with the purpose of improving the storage bag structure, allowing a user to squeeze air out of a storage bag easily, preventing air from flowing back into the storage bag so as to increase the storage effect of the storage bag, and providing a longer storage time.

The main object of the present invention is to provide an air-evacuable storage bag with multiple air exit holes allowing air therein to be expelled automatically.

To achieve the aim mentioned above, the present invention proposes an air-evacuable storage bag with multiple air exit holes, including two sheets of inner film, two sheets of outer film, a crosswise hot sealing line formed by hot-sealing the two sheets of outer film and the two sheets of inner film, a storage space used for accepting an article and an air exhaust area; where the two sheets of outer film includes a first end and a middle end; the two sheets of inner film is positioned between the two sheets of outer film and positioned between a top end and the middle end of the two sheets of outer film; the storage space is formed between the crosswise hot sealing line and the first end; the air exhaust area is formed between the crosswise hot sealing line and the top end of the two sheets of outer film; a plurality of air outlets are formed spatially between the two sheets of inner film at a place on which the crosswise hot sealing line is positioned; the air outlets can be opened automatically to allow air to be expelled out of the bag from the storage space first through the air outlets and then via the air exhaust area during air expulsion.

A plurality of strips of heat resistant material are spread in advance between the two sheets of inner film, the crosswise hot sealing line is stretched over each heat resistant material, the plurality of air outlets are formed at places on which the heat resistant materials between the two sheets of inner film are respectively spread; places in the storage space close to the middle end have a plurality of hot sealing portions, the hot sealing portions allow the adjacent outer and inner films to be adhered to each other, the hot sealing portions and the crosswise hot sealing line form an automatic open-close device, and each heat resistant material corresponds to at least one hot sealing portion.

The air exhaust area includes a plurality of air exhaust guide passages formed between the two sheets of inner film by adhering the two sheets of inner film to each other or the two sheets of inner film and the two sheets of outer film to each other by means of hot sealing, each air exhaust guide passage is connected to an air exit; each air exhaust guide passage has an exit portion, and one end of the air exhaust guide passage close to the exit portion is narrower than the other end of the air exhaust guide passage.

The air exhaust area also includes a plurality of air exhaust guide passages formed between the two sheets of inner film by adhering the two sheets of inner film to any sheet of outer film by means of hot sealing, and then adhering two sides of the two sheets of inner film and two sides of the two sheets of outer film to each other by means of hot sealing to cause the two sheets of inner film to be placed in between the two sheets of outer film; each air exhaust guide passage is connected to an air outlet; each air exhaust guide passage has at least one exit portion.

A plurality of special-shaped hot sealing points are distributed in the air exhaust area, each special-shaped hot sealing point is formed by adhering the two sheets of inner film to each other by means of hot sealing, or adhering the two sheets of inner film and the two sheets of outer film to each other by means of hot sealing, a plurality of air exhaust guide passages are formed among the special-shaped hot sealing points, each air exhaust guide passage has an exit portion.

The special-shaped hot sealing points are distributed randomly or regularly in the air exhaust area.

The special-shaped hot sealing point may be circular, elliptic, rectangular, square, triangular, rhomboidal, single-line-shaped, cross-shaped or #-shaped, the special-shaped hot sealing points assume a meshed distribution.

A plurality of strips of heat resistant materials are spread on the inner surfaces of the two sheets of inner film, the crosswise hot sealing line is stretched over each heat resistant material, the plurality of air inlets are formed at places between the two sheets of inner film spread with the hot resistant material, a top end of the air exhaust area and one side thereof are adhered to each other by means of hot sealing to form an air extracting guide passage, another side of the air exhaust area is formed with an exit portion; each air outlet is connected to the air extraction passage; a plurality of hot sealing portions are further positioned at a place of the storage space close to the middle end, the hot sealing portion causes the adjacent outer film and inner film to be adhered to each other, the hot sealing portions and the crosswise hot sealing line form an automatic open-close device, each heat resistant material corresponding to at least one hot sealing portion.

A plurality of opposite raised portions are respectively positioned on the inner faces of the two sheets of outer film in the storage space, the tow opposite raised portions are attached to each other during the air extraction, a gap is formed between each two raised portions attached together; an area of at least one of the heat resistant materials is larger than the other heat resistant material, the largest heat resistant material corresponds to the largest air outlet.

The plurality of raised portions are positioned at the largest heat resistant material and an area below it.

The plurality of raised portions are positioned between a middle part of the storage space and the crosswise hot sealing line.

A plurality of zigzag shaped areas formed by hot-sealing the two sheets of outer film and the two sheets of inner film are positioned in the air exhaust area, a bottom of the zigzag shaped area is formed with an intermittent crosswise hot sealing line, the air outlet is formed between each two adjacent gaps of the crosswise hot sealing line; the two sheets of outer film and the two sheets of inner film are adhered to each other in the zigzag shaped area; the two sheets of inner film are not adhered to each other and the two adjacent outer film and inner film are adhered to each other outside the zigzag shaped area; a plurality of air exhaust guide passages are formed between the two adjacent zigzag shaped areas, one end of each air exhaust guide passage is positioned with an exit portion connected to the outside; another end thereof communicated to the air outlet; one end of the air exhaust guide passage close to the exit portion is narrower than the other end of the air exhaust guide passage; one part of the storage space close to the middle end is further positioned with a linear hot sealing portion, the two sheets of inner film are not adhered to each other, and the adjacent inner film and outer film are adhered to each other at the linear hot sealing portion, the hot sealing portion and the crosswise hot sealing line form an automatic open-close device.

A plurality of longitudinal hot sealing lines, a plurality of special-shaped hot sealing points and an intermittent crosswise hot sealing line hot-sealing the two sheets of outer film and the two sheets of inner film are formed in the air exhaust area; the air outlet is formed between the two adjacent gaps of the crosswise hot sealing line; the special-shaped hot sealing points are distributed between the crosswise hot sealing line and a top end of the two sheets of outer film; the two sheets of outer film and the two sheets of inner film are adhered to each other at places on which the crosswise hot sealing line, the longitudinal hot sealing line the special-shaped hot sealing points are positioned; the two sheets of inner film are not adhered to each other and the two adjacent outer film and inner film are adhered to each other at places on which the crosswise hot sealing lines, the longitudinal hot sealing lines and the special-shaped hot sealing points are not positioned; a plurality of air exhaust guide passages are formed between the plurality of longitudinal hot sealing lines and the plurality of special-shaped hot sealing points, one end of each air exhaust guide passage is positioned with an exit portion connected to the outside, and another end thereof is connected to the air outlet; a place of the storage space close to the middle end is further positioned with a linear hot sealing portion, the two sheets of inner film are not adhered to each other, and the adjacent inner film and outer film are adhered to each other at a place on which the linear hot sealing portion is positioned, the hot sealing portion and the crosswise hot sealing line form an automatic open-close device.

A zigzag hot sealing line, a plurality of special-shaped hot sealing points and an intermittent crosswise hot seal are formed in the air exhaust area; the air outlet is formed between two adjacent gaps of the crosswise hot sealing line; the zigzag hot sealing line is positioned above the crosswise hot sealing line, the special-shaped hot sealing points are distributed between a top end of the outer film and the zigzag hot sealing line; the two sheets of outer film and the two sheets of inner film are adhered to each other at places on which the crosswise hot sealing line, the zigzag hot seal line, the special-shaped hot sealing points are positioned; the two sheets of inner film are not adhered to each other and the two adjacent outer film and inner film are adhered to each other places on which the crosswise hot sealing lines, the zigzag hot sealing lines and the special-shaped hot sealing points are not positioned; a plurality of air exhaust guide passages are formed between the plurality of zigzag hot sealing lines and the plurality of special-shaped hot sealing points, one end of each air exhaust guide passage is positioned with an exit portion connected to the outside, and another end thereof is connected to the air outlet; a place of the storage space close to the middle end is further positioned with a linear hot sealing portion, the two sheets of inner film are not adhered to each other, and the adjacent inner film and outer film are adhered to each other at a place on which the linear hot sealing portion is positioned, the hot sealing portion and the crosswise hot sealing line form an automatic open-close device; the zigzag hot sealing line constitutes a plurality of small saw teeth, each small saw tooth corresponding to one air outlet.

Two sides of the storage space are adhered by means of hot sealing, a close component is positioned on the first end; otherwise, a closing component is positioned on one of the two sides of the storage space, the other side and the first end thereof are adhered by means of hot sealing.

The air-evacuable storage bag with multiple air exit hole further includes a hanging element positioned on the first end or the air exhaust area. A part of the hanging element is positioned in the storage bag, another part thereof is positioned outside the storage bag, the hanging element includes two bending portions and a connection portion, the connection portion is used for connecting with the two bending portions, and the bending portions are used for hanging an article.

The hot sealing points used for constituting the hot sealing portion may be dot-typed, linear, rectangular, square, triangular or star-typed.

The present invention allows not only air outlets to be opened automatically, air exhaust to be smooth and speedy, and air locking to be maintained long term after the air is expelled, but also renders the structure simple and manufacturing easy.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

First Preferred Embodiment

Figure 1:
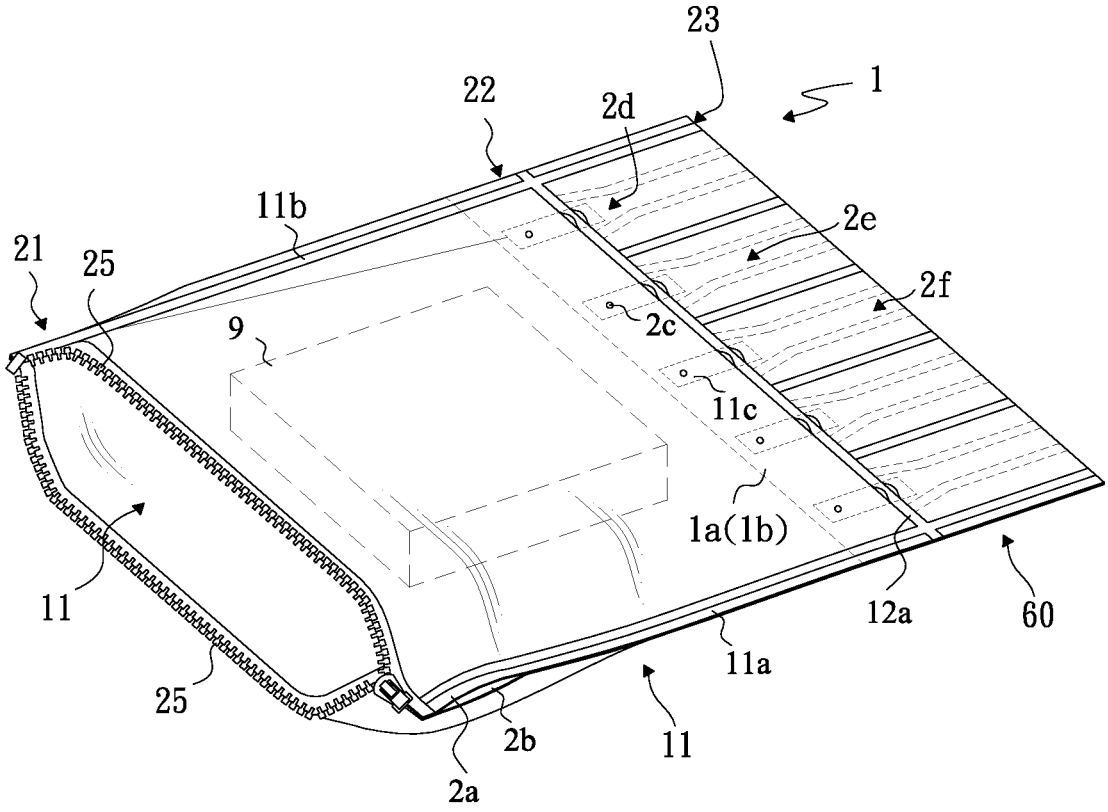
FIG. 1 is a perspective view, showing a storage bag of the first preferred embodiment according to the present invention in which an article is placed.

Please refer to FIGS. 1, 2A, 2B, 2C, 3A, 3B and 3C. FIGS. 1, 2A, 2B, 2C, 3A, 3B and 3C show an air-evacuable storage bag with multiple air exit holes of a first preferred embodiment according to the present invention.

An air-evacuable storage bag 1 with multiple air exit holes includes two sheets of outer film 2*a* and 2*b*, two sheets of inner film 1*a* and 1*b*, a storage space 11 used for accepting an article 9, an air exhaust area 60, a hot sealing portion 2*c*, a crosswise hot sealing line 12*a*, a plurality of air outlets 2*d*, a plurality of air exhaust guide passages 2*c* independently corresponding to the air outlets 2*d* and an exit portion 2*f*.

The two sheets of outer film 2*a* and 2*b* are stacked together vertically, with a first end 21 and a middle end 22 corresponding to each other positioned thereon. The two sheets of inner film 1*a* and 1*b*, stacked together vertically, are placed in between the two sheets of outer film 2*a* and 2*b*, the length of the two sheets of inner film are shorter than the length of the outer film 2*a* or 2*b*, one end of the two sheets of inner film is aligned with a top end of the two sheets of outer film, another end of the two sheets of inner film is aligned with the middle end 22. In addition, a plurality of strips of heat resistant material 11*c* are spread in advance between the two sheets of inner film 1*a* and 1*b*.

The two sheets of outer film 2*a* and 2*b*, the two sheets of inner film 1*a* and 1*b* are adhered to each other by means of hot sealing to form two side hot sealing lines and a crosswise hot sealing line 12*a* respectively stretched over middle sections of the plurality of strips of heat resistant material. The first end 21 of the two sheets of outer film 2*a* and 2*b* is further positioned with a close component 25, the storage space 11 is formed among the two side hot sealing lines 11*a* and 11*b*, the crosswise hot sealing line 12*a* and the first end 21 of the two sheets of outer film, an internal portion of the storage space 11 is used for placing in and storing an article 9. The close component 25 is a zipper or a fastener depending on demand, but the present invention is not limited to these.

A plurality of separated air outlets 2*d* are formed between the two sheets of inner film at places that the crosswise hot sealing line is stretched over the plurality of strips of heat resistant material, i.e. the air outlets 2*d* are formed at places that the plurality of strips of heat resistant material are spread between the two sheets of inner film because the two sheets of inner film are adhered to each other at places that the heat resistant material is spread, and the two sheets of outer film and the two sheets of inner film are adhered to each other closely due to hot sealing at places that the heat resistant material is not spread.

Figure 3A:
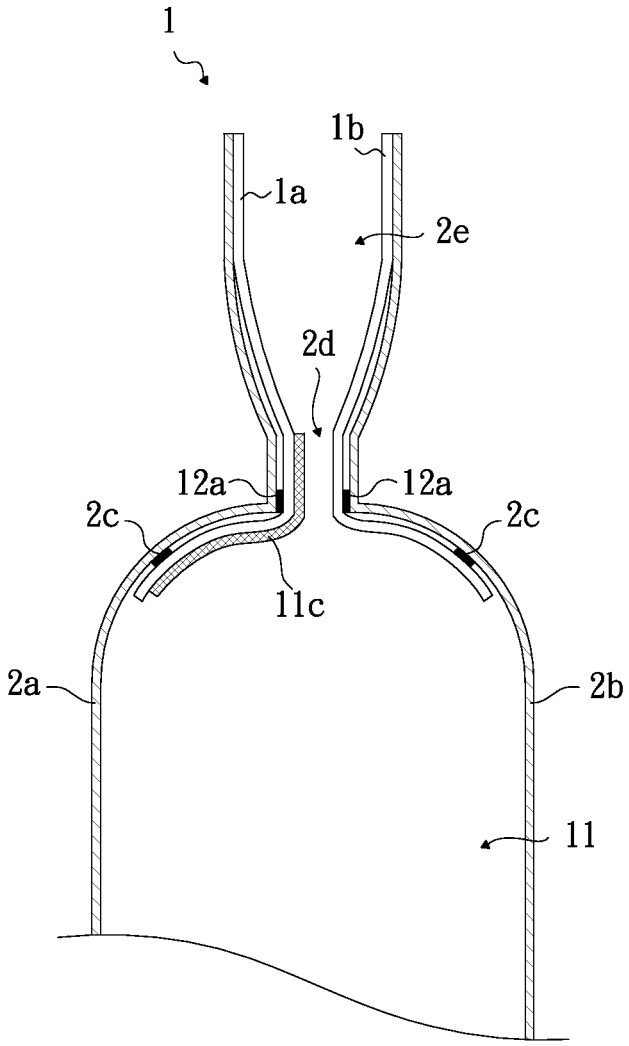
FIG. 3A is a cross sectional view taken along line A-A' of FIG. 2A.

A plurality of hot sealing portions 2*c* are further positioned at places of the storage space close to the middle end 11, the hot sealing portion 2*c* allows the adjacent outer film and inner film to be adhered to each other, each heat resistant material 11*c* corresponds to at least one hot sealing portion 2*c* as shown in FIG. 3A; the two sheets of inner film are not adhered to each other at places that the heat resistant material 11*c* is spread, the hot sealing portion 2*c* allows the outer film 2*a* and the inner film 1*a* as well as the outer film 2*b* and the inner film 1*b* to be adhered to each other, the hot sealing portion 2*c* and the crosswise hot sealing line 12*a* construct an automatic open-close device. A hot sealing point constructing the hot sealing portion 2*c* may be dotted, linear, rectangular, square, triangular or star-shaped, but the present invention is not limited to these.

The heat resistant material 11*c* mentioned above is only taken as an example, and the present invention is not limited to this. In addition, heat resistant spacers are placed in between the two sheets of inner film 1*a* and 1*b* to allow the two sheets of inner film not to be adhered to each other while being hot-sealed by upper and lower molds. Thereafter, the two sheets of inner films are transferred to a second processing area, a zigzag hot sealing mold is further used to create an intermittent hot sealing adhesion to the two sheets of outer film and inner film to prevent the two sheets of inner film adhering to each other outside a zigzag shaped area to form air outlets and air exhaust guide passages; the details concerning this will be described in the following embodiment.

In this embodiment, a plurality of air exhaust guide passages 2*c* are formed between the two sheets of inner film 1*a* and 1*b* by adhering the two sheets of inner film 1*a* and 1*b* by means of hot sealing, each air exhaust guide passage 2*c* corresponds to one strip of heat resistant material 11*c*. The air exhaust guide passage starts from the crosswise hot sealing line 12*a*, and the terminal thereof is formed with one exit portion 2*f*, or the terminal of the air exhaust guide passage 2*e* may be positioned with a plurality of exit portions. Each air outlet 2*d* is connected to one air exhaust guide passage 2*e*, hot sealing lines forming the air exhaust guide passage may be parallel to each other and perpendicular to the crosswise hot sealing line 12*a*, or one end of the air exhaust guide passage 2*e* close to the exit portion 2*f* is narrower than the another end of the air exhaust guide passage 2*e* to enable air to flow out of the storage bag easily from the air outlet 2*d* and then along the air exhaust guide passage 2*e* and to prevent it flowing back. Only if a continuous low pressure can be kept in the storage bag and the storage bag after the air exhaust can then be kept in a continuous air locking state.

Figure 3B:
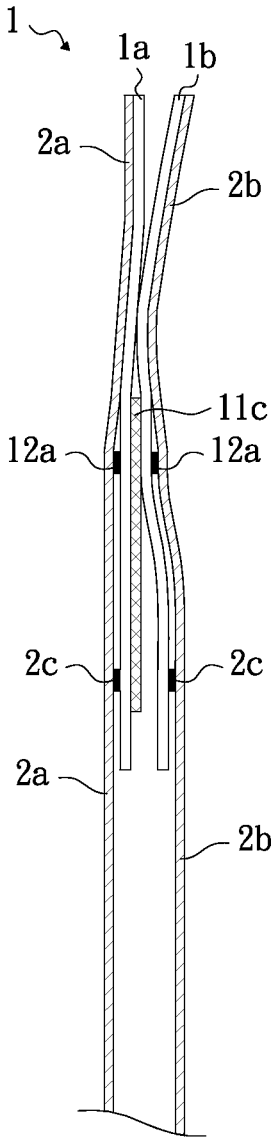
FIG. 3B is another cross sectional view taken along line A-A' of FIG. 2A.
Figure 3C:
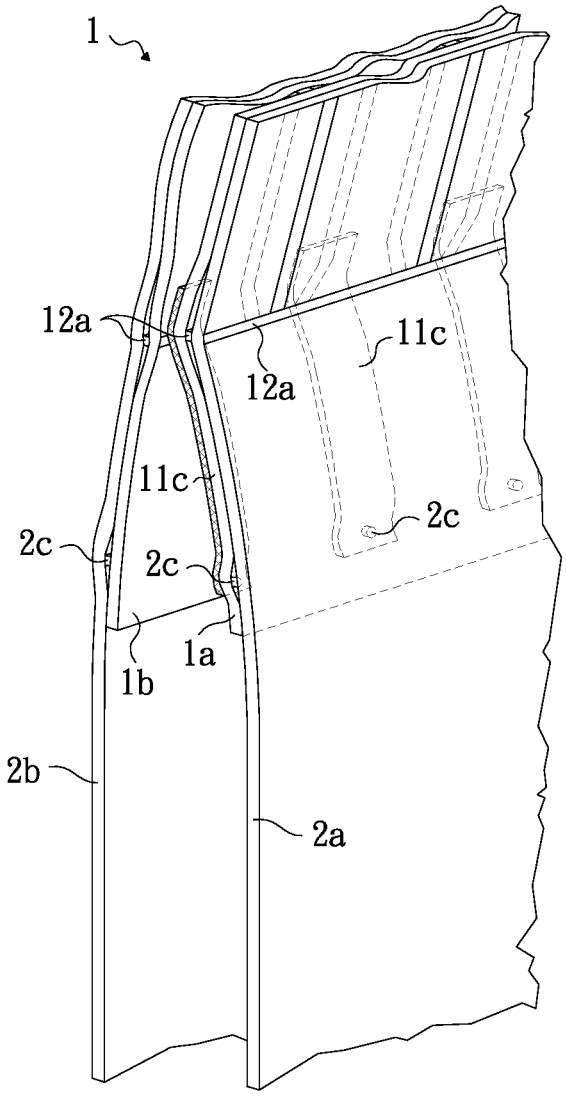
FIG. 3C is a perspective view, showing an inner structure of a storage bag of the first embodiment of the present invention.
Figure 4:
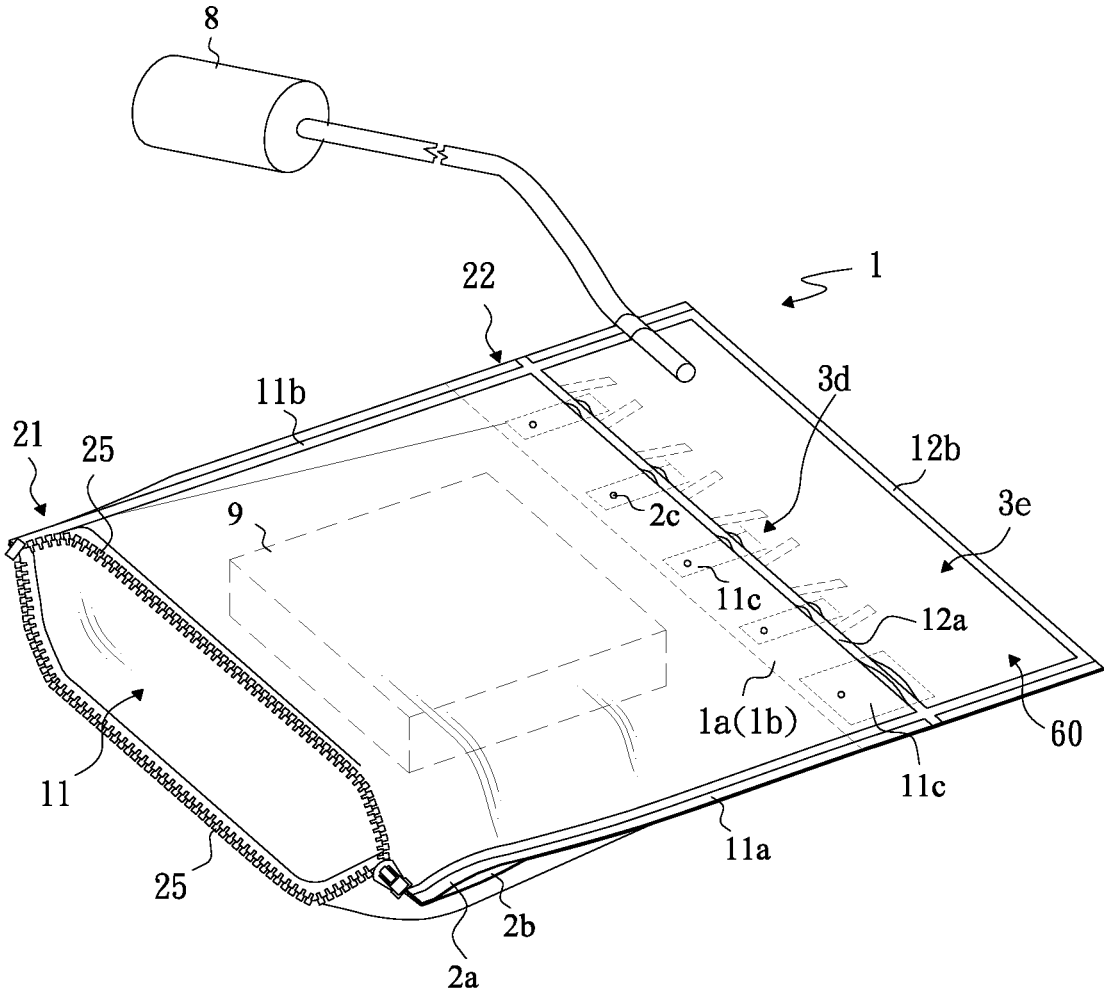
FIG. 4 is a perspective view, showing a storage bag of a second preferred embodiment according to the present invention in which an article is placed.
Figure 5:
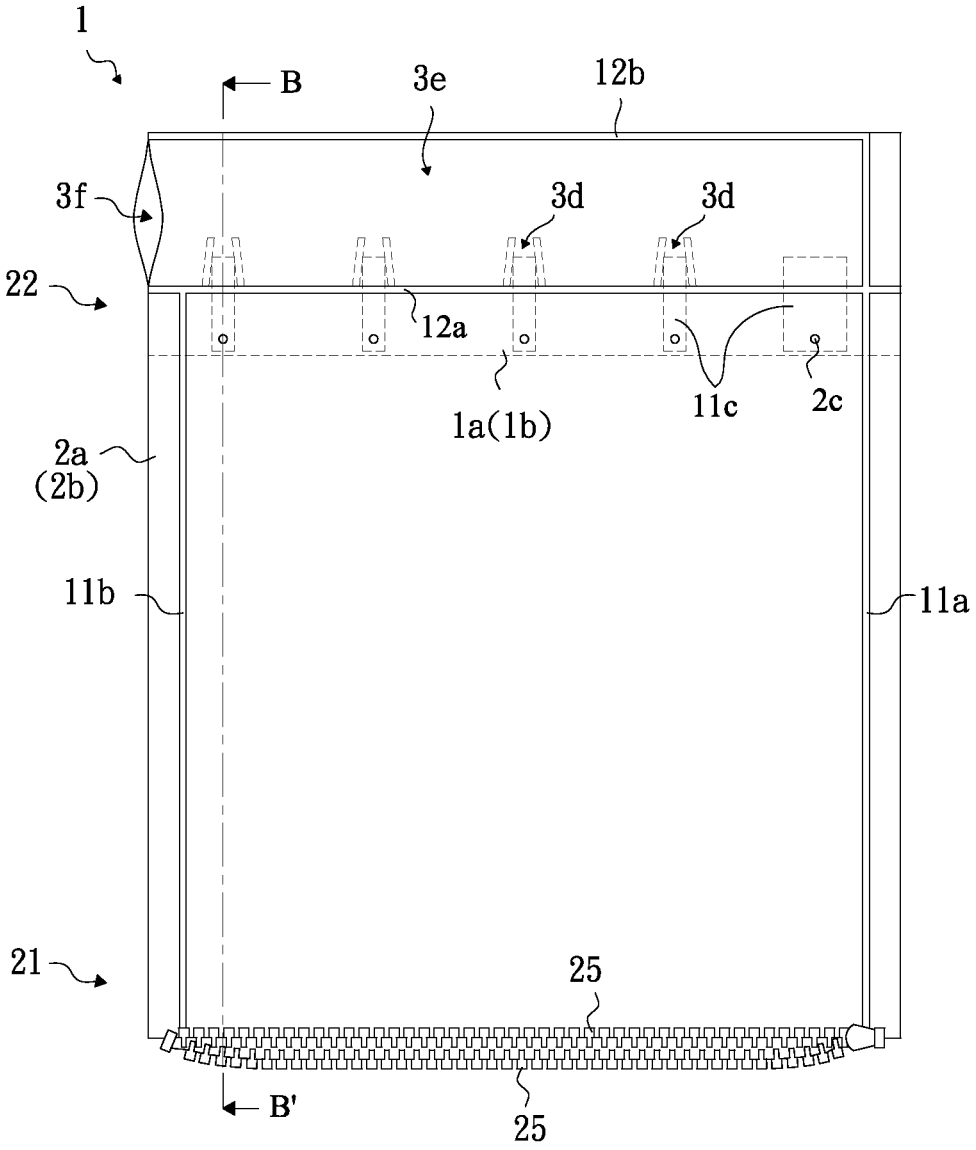
FIG. 5 is a plane view, showing a storage bag of a second preferred embodiment according to the present invention.

An attraction force in the air exhaust guide passage 2*e* will attract the two sheets of inner film 1*a* and 1*b* positioned at the air exhaust guide passage 2*e* to each other naturally because air pressure in the storage space 11 will cause a reverse attraction force as shown in FIG. 3B after air is expelled out of the storage bag from the air outlet 2*d* and then along the air exhaust guide passage 4*e* 2*e*, and attach to each other closely to form an air sealing so as to achieve the locking effect of preventing air from flowing back after being expelled according to the present invention.

Figure 2A:
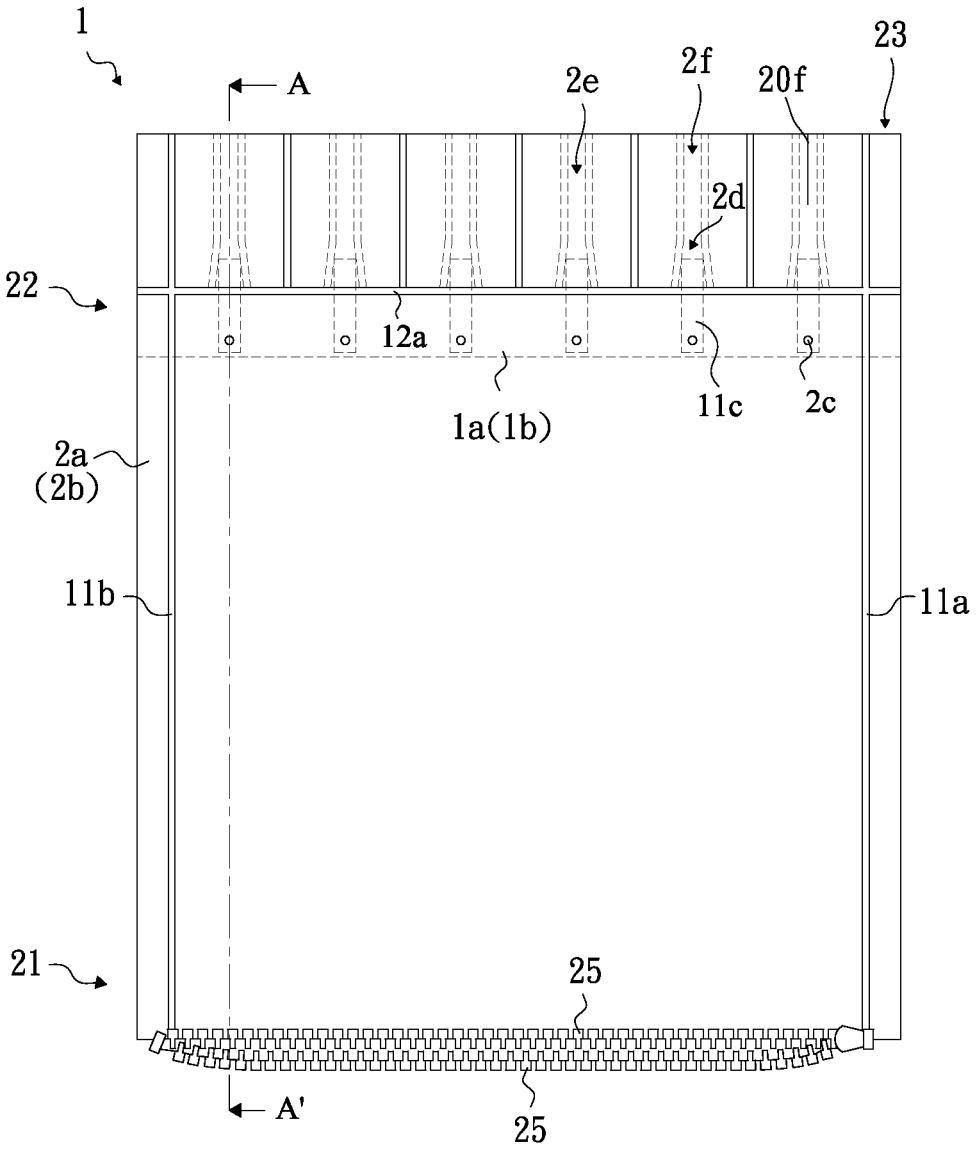
FIG. 2A is a plane view, showing the structure of a storage bag of the first embodiment according to the present invention.

Furthermore, to allow the two sheets of inner film to be attached to each other more closely after the air exhaust is completed, an additional hot sealing line 20*f* hot-sealing the two sheets of inner films or an additional hot sealing line hot-sealing the two sheets of outer film and the two sheets of inner film is positioned longitudinally at a place of the air exhaust guide passage 2*e* close to the exit portion 2*f* so as to form two exit portions as FIG. 2A shows. Otherwise, meshed hot sealing points or a plurality of additional hot sealing lines 20*f* are formed on the air exhaust guide passage by means of hot sealing to form a plurality of exit portions so as to attain a better air sealing effect.

Open the close component 25 first, place the article 9 into the storage space 11, and then close the close component 25 to shield the storage space 11 while using an air evacuable storage bag with multiple exit holes. To allow the article 9 to have a better storage effect and reduce space occupied by an article, a user may squeeze the two sheets of outer film 2*a* and 2*b* from the first end 21 toward the middle end 22 to cause air in the storage space 11 to push the middle end 22 of the two sheets of outer film away, i.e. cause the two sheets of outer film to be separated at the middle end 22. Because the outer film 2*a* and the inner film 1*a* as well as the outer film 2*b* and the inner film 1*b* are adhered by the hot sealing portions 2*c*, and the plurality of strips of heat resistant material 11*c* are spread on the predetermined places between the two sheets of inner film 1*a* and 1*b*, when air is inserted to create an expansion after the two sheets of outer film 2*a* and 2*b* are opened, because the hot sealing portions 2*c* are positioned between the outer film and the inner film, the two sheets of inner film 1*a* and 1*b* are pulled apart simultaneously due to the expansion to cause the air outlet to be opened to achieve air expulsion, allowing the hot sealing portion 2*c* and the crosswise hot sealing line 12*a* to have a open-close leverage; it is called referred to as an automatic open-close device of the air outlet. Once the open-close device is opened, each air outlet can then be opened to allow the air in the storage space 11 to flow out of the bag from the plurality of air outlets 2*d* and then along their own independent air exhaust guide passage 2*e* to achieve easy and speedy air expulsion. Furthermore, air pressure in the storage space 11 is lower after air exhaust, and this pressure difference between the inside and the outside of the bag creates a reverse attraction force to inhale air from outside the bag. As the air exhaust guide passage 2*e* is formed by adhering the two sheets of inner film 1*a* and 1*b* by means of hot sealing, the two sheets of inner film are similar to two valves in a pipe. As FIG. 3A shows, the attraction force will cause the two sheets of inner film to contract inward and attach to each other closely, thereby stopping outside air flowing in, and an air sealing effect which prevents the air flowing back, achieving long lasting air retention. Furthermore, the two sheets of outer film also have an auxiliary function of sealing air because the two sheets cover the two sheets of inner film. The automatic open-close device is positioned on the air outlet of the present invention so that it can easily solve the problem caused by the open-close of the air outlet being incomplete and air expulsion is difficult when the diameter of the air outlet is small and the number of air outlets is high.

Furthermore, in the present embodiment the two sheets of inner film 1*a* and 1*b* and any one sheet of outer film 2*a* or 2*b* may also be adhered to each other first by means of hot sealing so as to form a plurality of air exhaust guide passages 2*e* between the two sheets of inner film, and two sides of the two sheets of inner film and the two sheets of outer film may then be adhered to each other by means of hot sealing, thereby allowing the two sheets of inner film to be placed in between the two sheets of outer film 2*a* and 2*b*.

Figure 2B:
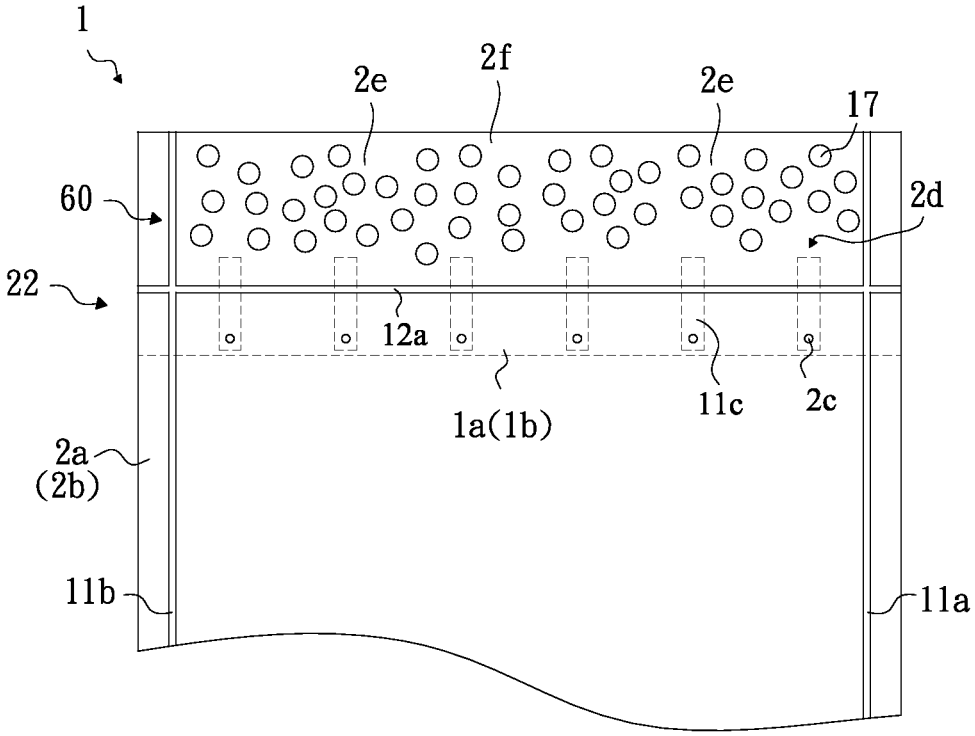
FIG. 2B is a plane view, showing another structure of an air exhaust area of the first embodiment according to the present invention.
Figure 2C:
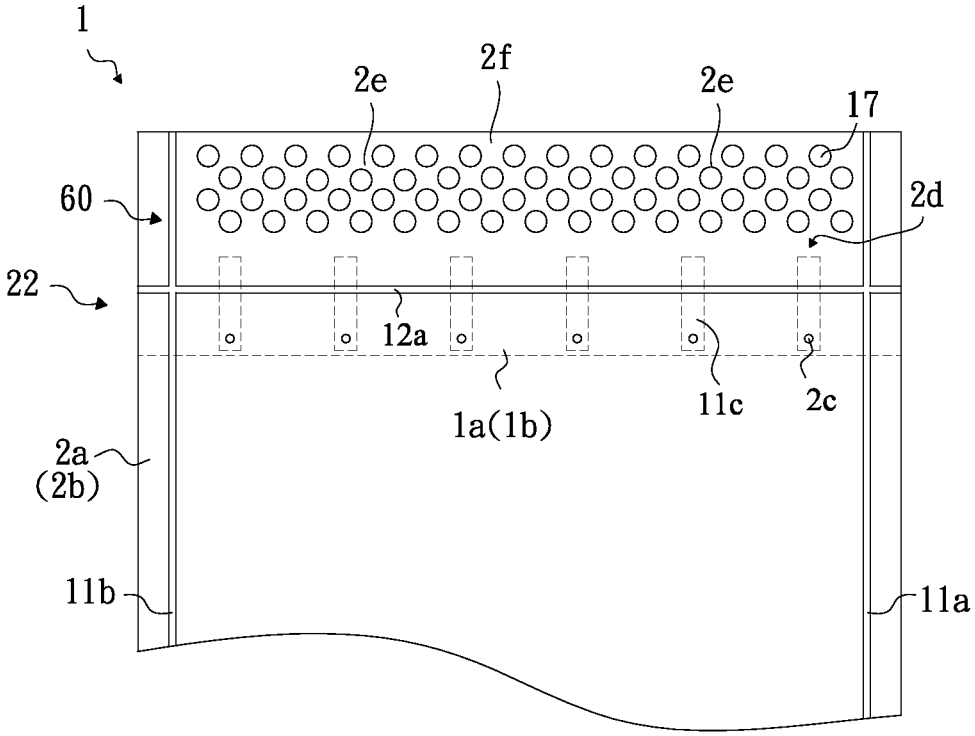
FIG. 2C is a plane view, showing still another structure of an air exhaust area of the first embodiment according to the present invention.

FIG. 2B shows another example of the present embodiment, in which a plurality of mesh-like special-shaped hot sealing points 17 are distributed randomly in the air exhaust area 60; each special-shaped hot sealing point 17 is formed by adhering the two sheets of inner film to each other by means of hot sealing, or formed by adhering the two sheets of inner film and the two sheets of outer film to each other by means of hot sealing. A plurality of air exhaust guide passages 2*e* are formed among the randomly distributed special-shaped hot sealing points 17, each air exhaust guide passage 2*e* is positioned with an exit portion 2*f*; the exhausted air enters the outside via the plurality of exit portions. The special-shaped hot sealing points 17 may be distributed regularly like water flow as in FIG. 2C. The special-shaped hot sealing point 17 may be all kinds of shapes, such as circle, ellipse, rectangle, triangle, rhombus, liner shape, cross shape, # shape and etc., but the present invention is not limited to these. Special-shaped hot sealing points may increase considerably the air locking effect after the air exhaust.

Second Preferred Embodiment

Please refer to FIGS. 4, 5, 6A, 6B and 6C. FIGS. 4, 5, 6A, 6B and 6C show an air-evacuable storage bag with multiple air exit holes of a second preferred embodiment according to the present invention.

In the present embodiment, the two sheets of inner film 1*a* and 1*bm* stacked together, vertically are placed in between the two sheets of outer film 2*a* and 2*b*, lengths of the two sheets of inner film are respectively shorter than a length of the outer film 2*a* or 2*b*, and one end of the two sheets of inner film is aligned with a top end of the two sheets of outer film, another end of the two sheets of inner film is aligned with the middle end 22. A plurality of strips of heat resistant material 11*c* are spread between the two sheets of inner film in advance. The present embodiment is also positioned with two side hot sealing lines 11*a*, 11*b* and a crosswise hot sealing line 12*a* stretched over the middle sections of the plurality of strips of heat resistant material 11*c*.

A plurality of hot sealing portions 2*c* are further positioned at places in the storage space 11 close to the middle end 22; each heat resistant material 11*c* corresponds to at least one hot sealing portion 2*c*. Sections of the two sheets of inner film positioned with the plurality of strips of heat resistant material 11*c* are not adhered together, and the hot sealing portion 2*c* allows the outer film 2*a* and the inner film 1*a* to be adhered to each other as well as the outer film 2*b* and the inner film 1*b* to be adhered to each other.

A plurality of separated air outlets 3*d* are formed between the two sheets of inner film at places where the crosswise hot sealing line is stretched over the plurality of strips of heat resistant material, i.e. the air outlets 2*d* are formed at places that the plurality of strips of heat resistant material is spread between the two sheets of inner film, the two sheets of inner film are not adhered to each other at the air outlets, the two sheets of inner film are respectively adhered to the adjacent outer films. An area of at least one heat resistant material 11*c* is larger than an area of other heat resistant material, and the heat resistant material with the largest area corresponds to the largest air outlet.

Top ends of the two sheets of outer film 2*a* and 2*b* are adhered to each other by means of hot sealing a top end hot sealing line 12*b*, and sides of the two sheets of outer film between the crosswise hot sealing line 12*a* and the top end hot sealing line 12 are adhered to each other by means of hot sealing, and the opposite sides thereof are not adhered to each other by means of hot sealing to form an exit portion 3*f* thereby allowing an air-extraction guide passage 3*e* with one side thereof provided with the exit portion 3*f* is formed between the two sheets of inner film between the crosswise hot sealing line 12*a* and the top end hot sealing line 12*b*.

Figure 6A:
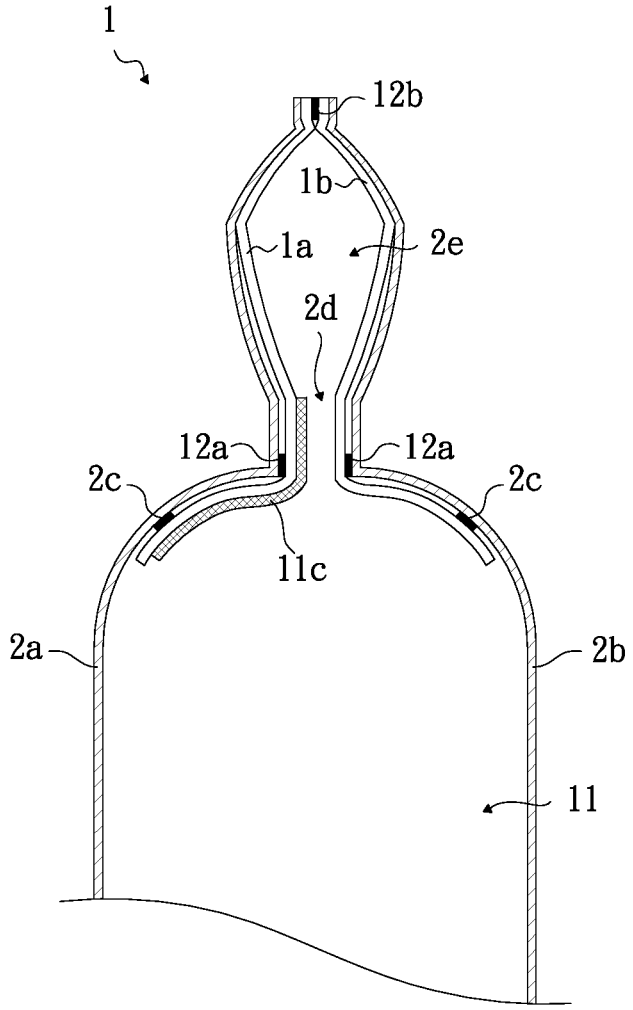
FIG. 6A is a cross sectional view taken along line B-B' of FIG. 5.
Figure 6B:
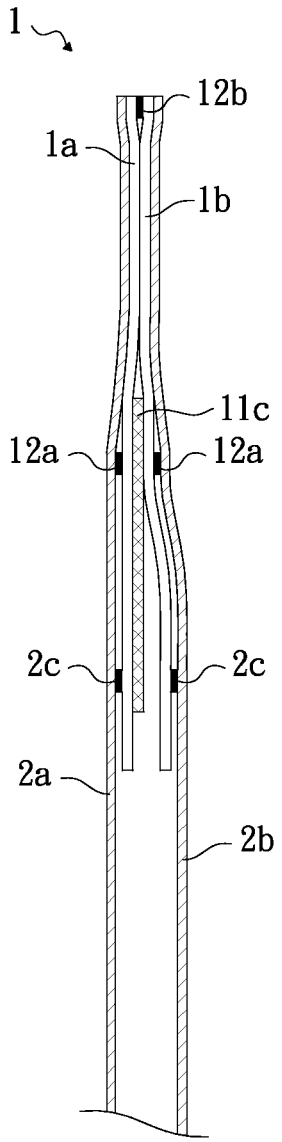
FIG. 6B is another cross sectional view taken along line B-B' of FIG. 5.
Figure 6C:
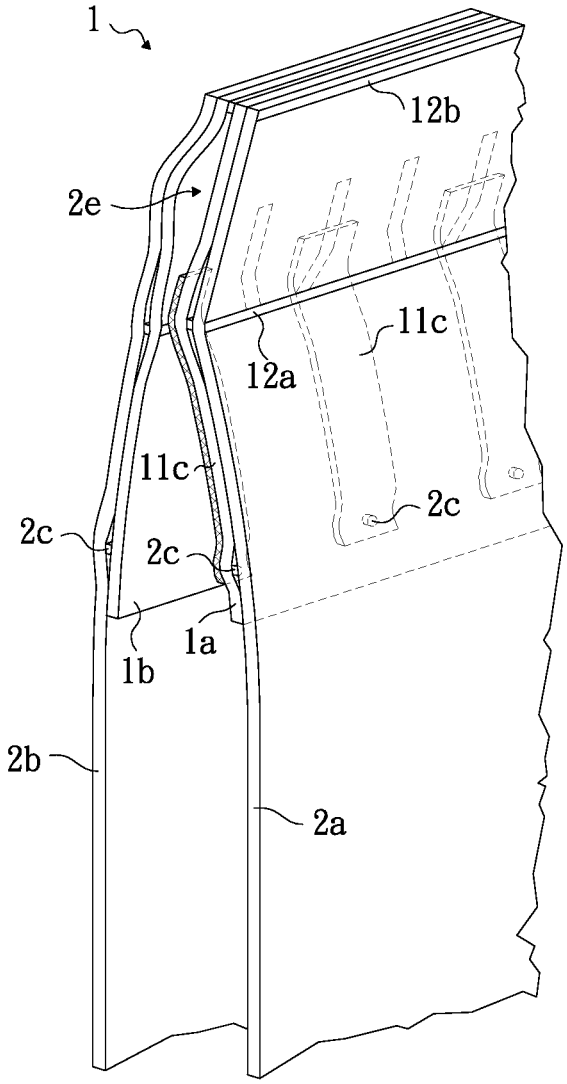
FIG. 6C is a perspective view, showing the internal structure of a storage bag of the second embodiment according to the present invention.

The air in the storage space 11 is squeezed toward the middle end 22 after an article is placed in the storage space 11 and a close component 25 is used to shield the first end 21 to allow the two sheets of outer film 2*a* and 2*b* to expand and stretch out at the middle end due to air pressure. The two sheets of inner film 1*a* and 1*b* will be pulled apart simultaneously owing to the dispositions of the hot sealing portions 2*c* thereby opening the air outlets 3*d* to allow air to flow into the air extraction guide passage 3*e*. Meanwhile, an air extraction tool 8 is inserted into the air extraction guide passage 3*e* via the exit portion 3*f* to extract the air through the air extraction guide passage 3*e*. A reverse attraction force will be yielded when the air pressure of the storage space 11 is sufficiently low to cause the two sheets of inner film 1*a* and 1*b* in the air extraction guide passage 3*e* to be attached to each other closely as FIG. 6B shows, and further to prevent air outside the storage space 11 from flowing back, thus achieving long lasting air retention after the exhausted air extraction. An electromotive extraction may be used to solve the problem of slow manual extraction or the situation in which an article is unable to be pressed when an area of the storage space 11 is large.

Third Preferred Embodiment

Figure 7:
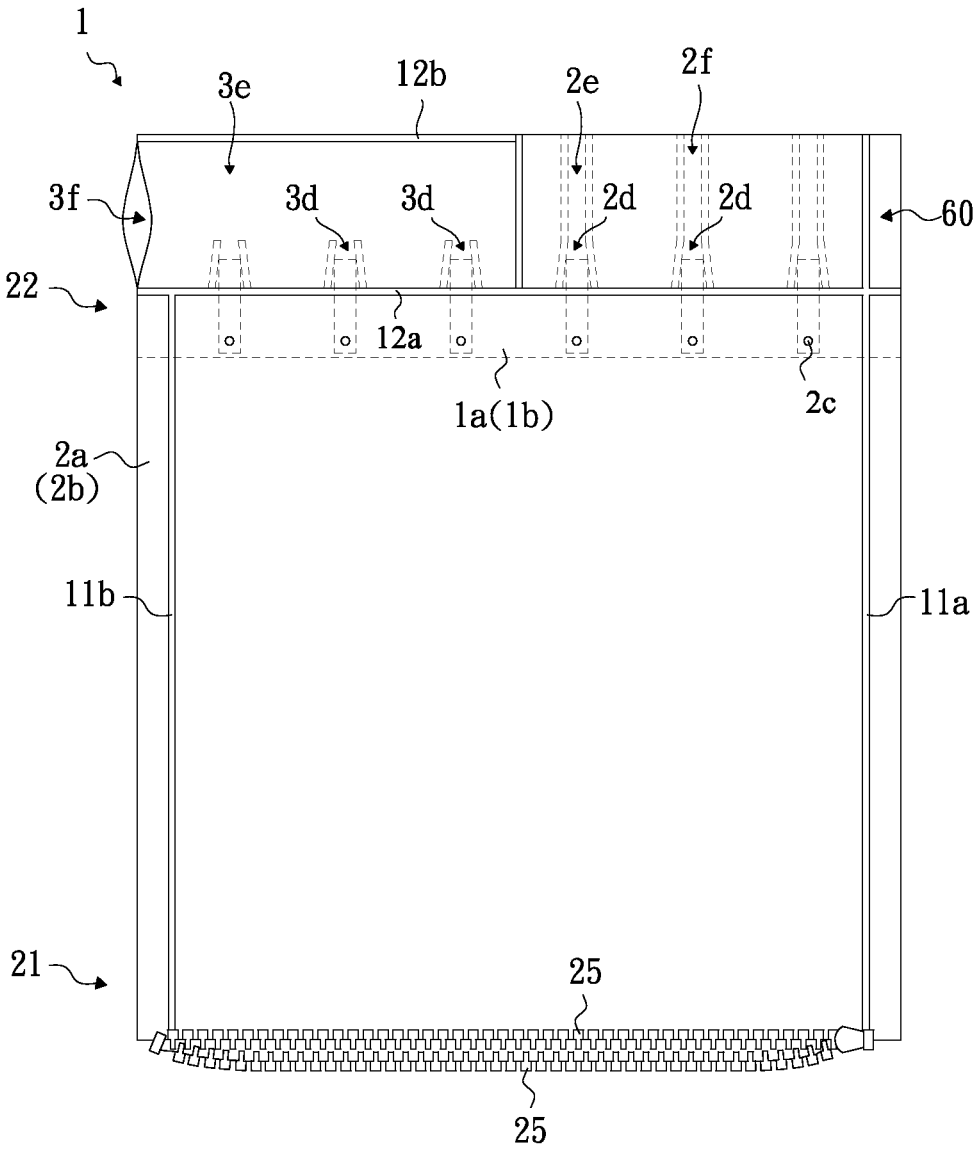
FIG. 7 is a plane view, showing a storage bag of a third preferred embodiment according to the present invention.

FIG. 7 shows an air evacuable storage bag with multiple air exit holes of a third preferred embodiment according to the present invention.

In the present embodiment, the air exhaust area 60 between the crosswise hot sealing line 12*a* and the top end of the two sheets of outer film is divided into two parts separated by a hot sealing line; one of the two parts is positioned with the air outlets 2*d* and the air exhaust guide passages 2*e* of the first embodiment mentioned above, another part is positioned with air outlets 3*d* and the air extraction guide passage 3*e* of the second embodiment mentioned above, i.e. an air exhaust area of a storage bag 1 is provided with two collateral air exhaust structures; this may not only extract air out of the air extraction guide passage 3*e* but also use hands to squeeze the storage space 11 to enable the air to be expelled out via the plurality of air outlets 2*d*.

Fourth Preferred Embodiment

Figure 8:
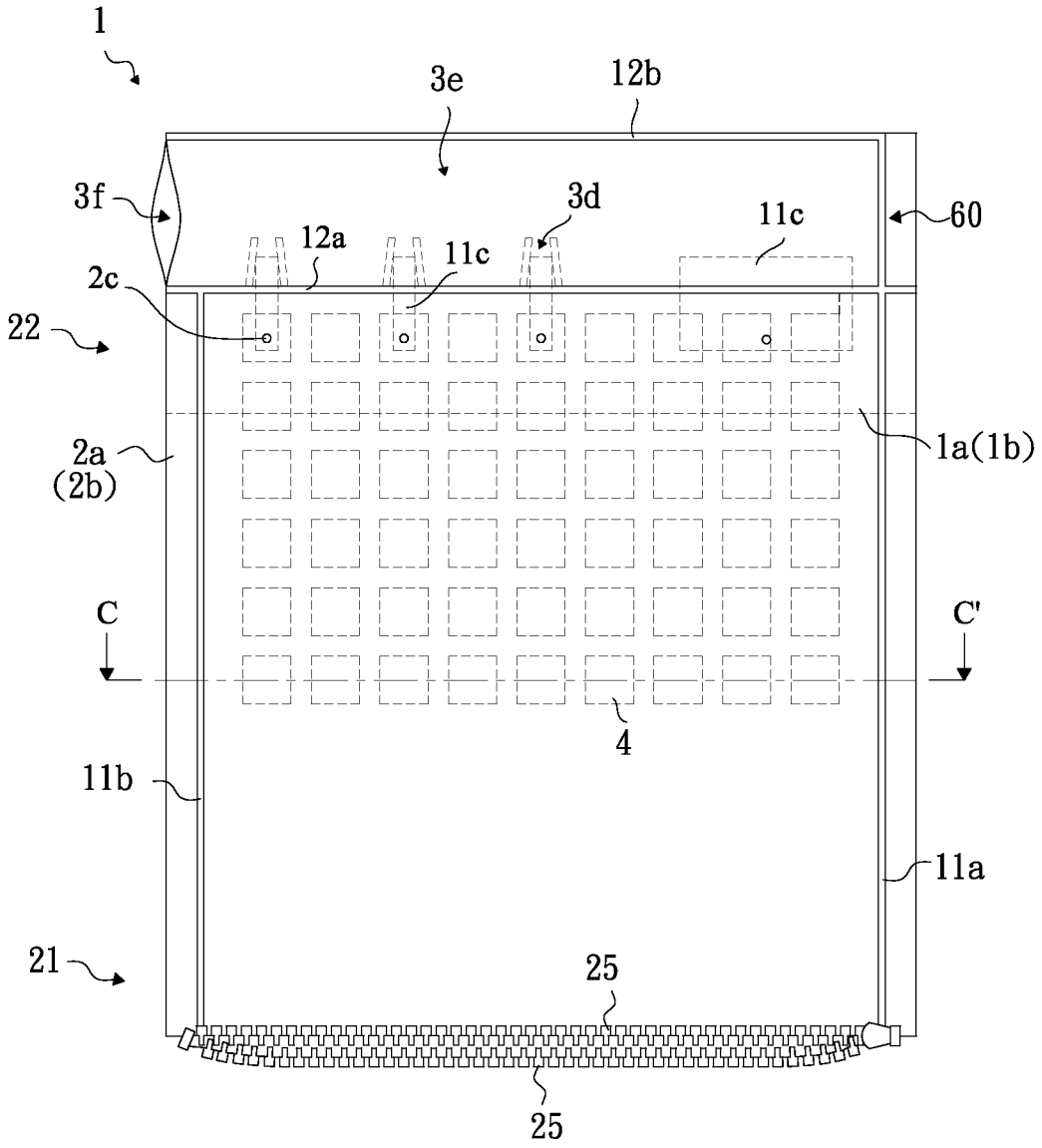
FIG. 8 is a plane view, showing a storage bag of a fourth preferred embodiment according to the present invention.
Figure 9A:
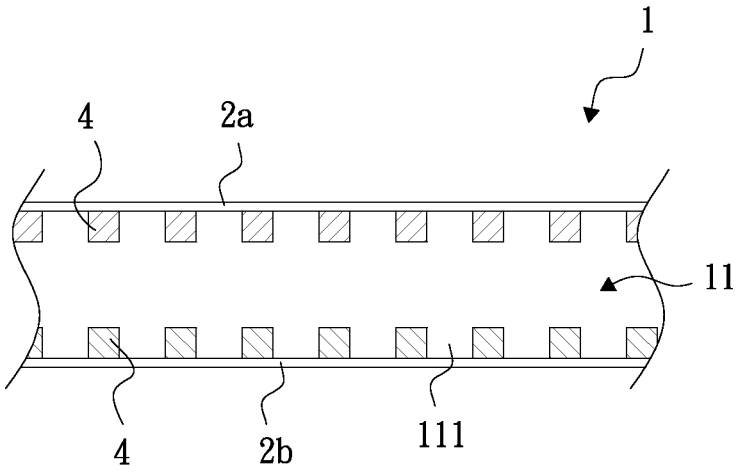
FIG. 9A is a cross sectional view taken along line C-C' of FIG. 8.
Figure 9B:
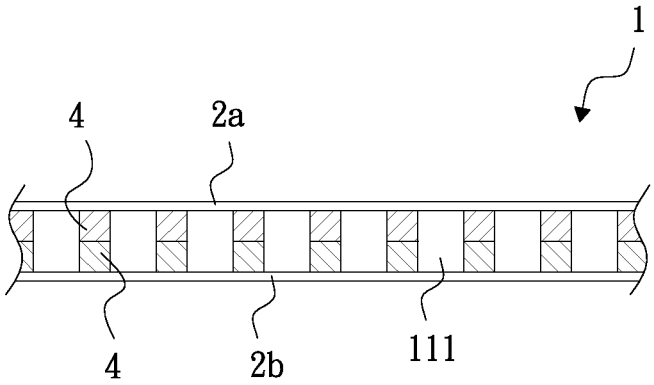
FIG. 9B is another cross sectional view taken along line C-C' of FIG. 8.

FIGS. 8, 9A and 9B show an air evacuable storage bag with multiple air exit holes of a fourth preferred embodiment according to the present invention.

In the present embodiment, a plurality of opposite projecting raised portions 4 are respectively positioned on the inner faces of the two sheets of outer film to prevent the two sheets of outer film 2*a* and 2*b* at the middle end 22 from being attached together when a user is using the air-extracting tool 8 to extract air, to allow the air at the first end 21 to be extracted. The two sheets of outer film 2*a* and 2*b* are not attached together during the air extraction, but the two opposite raised portions 4 on the outer films are attached to each other and the plurality of gaps 111 will be formed between all opposite raised portions to enable the air to flow to the air outlets 3*d* through the gaps 111 and then flow into the air extraction guide passage 3*e* via the air outlets 3*d* to achieve air expulsion. The raised portions 4 are distributed between the crosswise hot sealing line 12*a* and a middle part of the storage space 11.

Fifth Preferred Embodiment

Figure 10A:
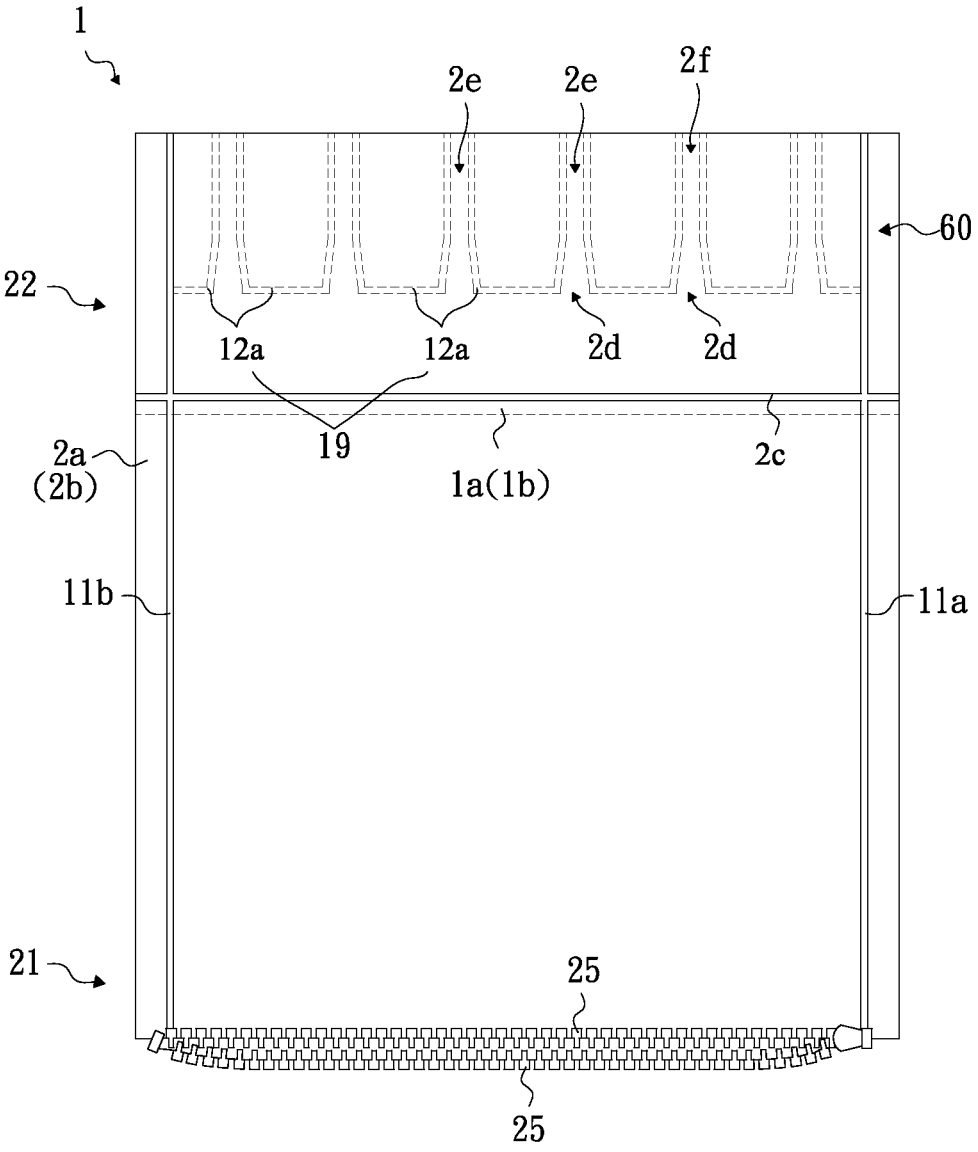
FIG. 10A is a plane view, showing the structure of a storage bag of the fifth embodiment according to the present invention.
Figure 10B:
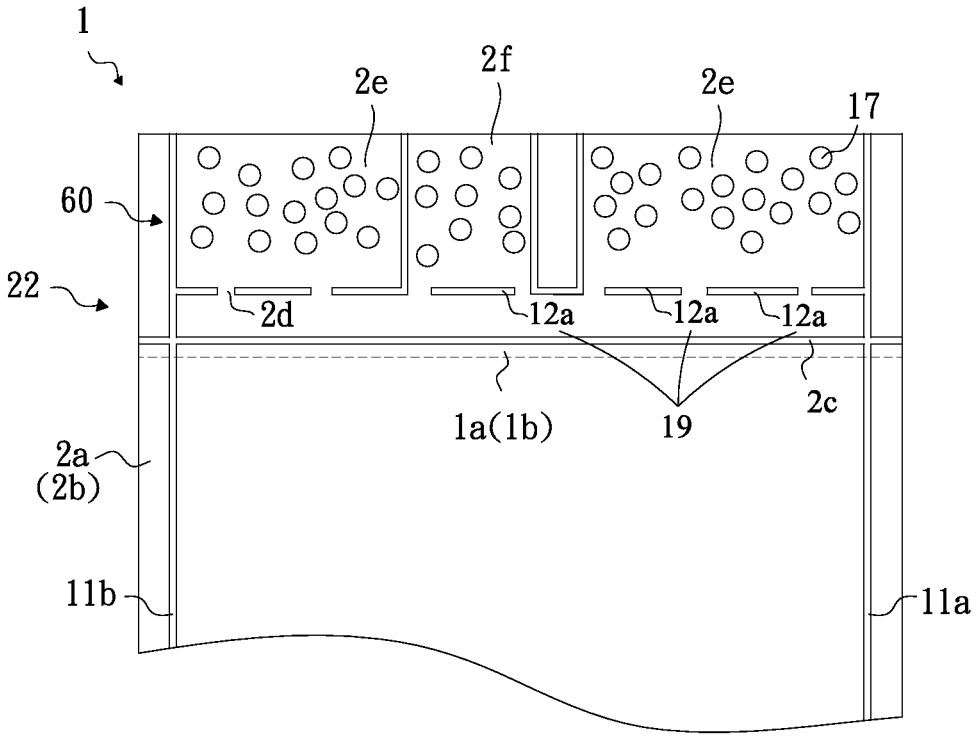
FIG. 10B is a plane view, showing another structure of an air exhaust area of the fifth embodiment according to the present invention.
Figure 10C:
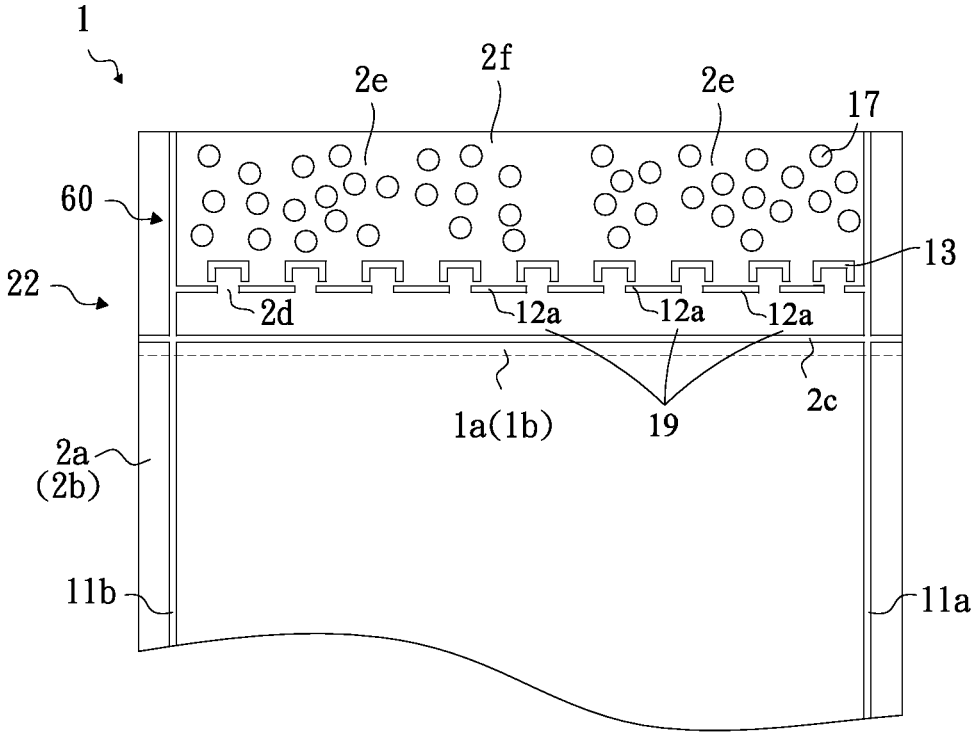
FIG. 10C is a plane view, showing still another structure of an air exhaust area of the fifth embodiment according to the present invention.
Figure 11A:
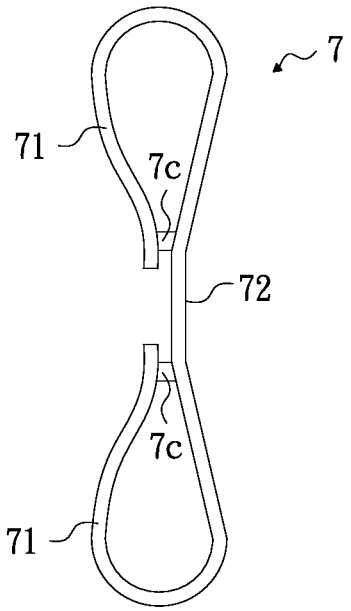
FIG. 11A is a schematic view, showing a hanging element of a sixth preferred embodiment according to the present invention.
Figure 11B:
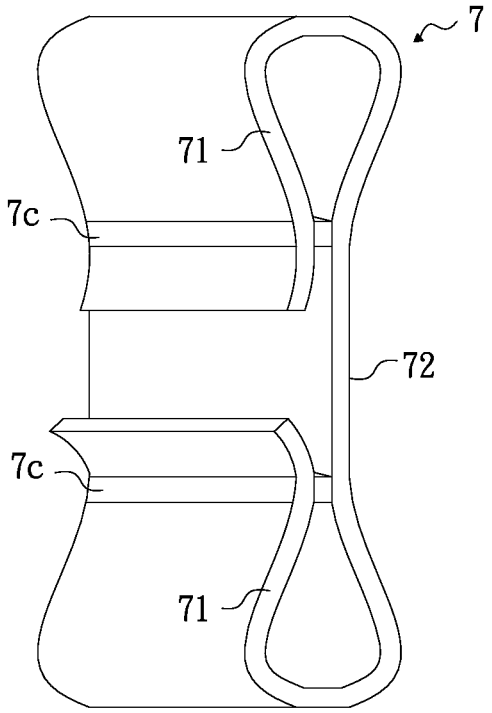
FIG. 11B is a schematically perspective view, showing a hanging element of the sixth preferred embodiment according to the present invention.

FIGS. 10A, 10B and 10C show an air evacuable storage bag with multiple air exit holes of a fifth preferred embodiment according to the present invention.

In the present invention, a zigzag hot sealing mold is used to process an intermittent hot sealing adhesion to the two sheets of outer film 2*a* and 2*b* as well as the two sheets of inner film 1*a* and 1*b*, in which zigzag shaped areas 19 having a zigzag mode are sealed, and each non-zigzag shaped areas is formed with an air outlet and an air exhaust guide passage. Specific construction steps follow:

Step 1: placing a heat resistant spacer in between the two sheets of inner film 1*a* and 1*b*, using the hot sealing mold to hot-seal the two sheets of outer film and the two sheets of inner film from above and below simultaneously; forming a linear hot sealing portion 2*c* which may be broad and wide or narrow and long, and adhering the outer film 2*a* to the inner film 1*a*, not adhering the two sheets of inner film 1*a* and 1*b* to each other and adhering the outer film 2*b* to the inner film 1*b* in the hot sealing area including the linear hot sealing portion 2*c* to achieve the effect of allowing the two sheets of inner film to be expanded with the two sheets of outer film simultaneously to pull apart thereby opening the air outlets 2*d* automatically after the hot sealing.

Step 2: transferring the aforementioned films to a second processing area after taking out the heat resistant spacer, using a zigzag mold to process hot sealing to the two sheets of inner film and the two sheets of outer film above the hot sealing portion 2*c* as FIG. 10A shows, forming zigzag shaped areas 19 at places with saw teeth after the hot sealing, in which bottoms of the zigzag areas 19 are formed with an intermittent crosswise hot sealing line 12*a*, an air outlets 2*d* is formed between each two adjacent gaps of the crosswise hot sealing line 12*a*, the two sheets of outer film and the two sheets of inner film are adhered to each other closely in the zigzag shaped area 19, the two sheets of inner film are not adhered to each other and the inner film is adhered to the adjacent outer film outside the zigzag shaped area 19, a plurality of air exhaust guide passages 2*e* are formed between all each two adjacent zigzag shaped areas 19, one end of the air exhaust guide passage 2*e* is connected with the air outlet and another end thereof is positioned with an exit portion 2*f*.

Whilst the two sheets of outer film 2*a* and 2*b* are expanded to pull apart due to the air exhaust, the two sheets of inner film will be pulled apart automatically with the two sheets of outer film, simultaneously causing the air outlets 2*d* to be opened automatically, air in the storage space 11 flows out via the air outlets 2*d*, the air exhaust guide passage 2*e* and the exit portion 21 in sequence. The hot sealing portion 2*c* and the crosswise hot sealing line 12*a* form an automatic open-close device.

The air exhaust guide passage 2*e* is formed between the two sheets of inner film and assumes a body with a narrower upper side thereof and a wider lower side thereof, i.e. one end of the air exhaust guide passage 2*e* close to the exit portion 2*f* is narrower than another end thereof, but the present invention is not limited to this. In addition, the air exhaust guide passage 2*e* may also be formed between two parallel hot sealing lines. Air in the storage bag pulls up the two sheets of inner film at the hot sealing portion 2*c* to allow the two sheets of inner film to be separated during the air exhaust, and further to allow air to flow out from the air outlets 2*d* and via the air exhaust guide passages 2*e*. Because air pressure in the storage space 11 is small, a reacting force inhaling outside air is formed in the storage space 11, the two sheets of inner film attract each other to allow them to be attached to each other to form a blocking to prevent outside air from entering the bag thereby achieving long lasting air retention.

FIG. 10B shows another example; the difference between it and FIG. B is that the mold shape used in the present example is different from the one used in the Step 2 mentioned above, and the mold is used in the air exhaust area 60 to adhere the two sheets of outer film and the two sheets of inner film by means of hot sealing to form a plurality of special-shaped hot sealing points 17, intermittent crosswise hot sealing line 12*a* and a plurality of longitudinal hot sealing lines. The special-shaped hot sealing points are distributed between the crosswise hot sealing line and a top end of the two sheets of inner film; the two sheets of outer film and the two sheets of inner film are adhered to each other at the crosswise hot sealing line, the longitudinal hot sealing lines and the special-shaped hot sealing points; the two sheets of inner film are not adhered to each other and the two adjacent outer and inner films are adhered to each other outside the crosswise hot sealing line, the longitudinal hot sealing lines and the special-shaped hot sealing points. An air outlet 2*d* is formed between each pair of two adjacent gaps of the crosswise hot sealing line. A plurality of air exhaust guide passages 2*e* are formed among the plurality of longitudinal hot sealing lines and the plurality of special-shaped hot sealing points, one end of each air exhaust guide passage is positioned with an exit portion 2*f* connected to outside, another end thereof is connected to the air outlet. The two sheets of inner film will be pulled apart, causing the air outlets 2*d* to be opened automatically when the two sheets of outer film are separated due to the expansion because of the positioning of the hot sealing portion 2*c*, and the air in the storage space flows out of the bag via the air outlets 2*d*, the air exhaust guide passages 2*e* and the exit portions 2*f* in sequence.

FIG. 10C shows still another example. The mold is used in the air exhaust area 60 to hot-seal the two sheets of outer film and the two sheets of inner film to form a crosswise hot sealing line 12*a*, a zigzag hot sealing line 13 and a plurality of special-shaped hot sealing points 17. The two sheets of outer film and the two sheets of inner film are adhered to each other at the crosswise hot sealing line, the zigzag hot sealing line and the special-shaped hot sealing points; the two sheets of inner film are not adhered to each other and the two adjacent outer and inner films are adhered to each other outside the crosswise hot sealing line, the zigzag hot sealing line and the special-shaped hot sealing points, an air outlet 2*d* is formed between each pair of adjacent gaps of the crosswise hot sealing line, the zigzag hot sealing line 13 is positioned above the crosswise hot sealing line, the zigzag hot sealing line 13 is constituted by a plurality of small saw teeth, where each small saw tooth corresponds to one air outlet 2*d*. The special-shaped hot sealing points 17 are formed between a upper part of the zigzag hot sealing line 13 and a top end of the outer film. A plurality of air exhaust guide passages 24 are formed between each special-shaped hot sealing point and the zigzag hot sealing line, one end of each air exhaust guide passage is positioned with an exit portion 2*f*, another end thereof is connected to the air outlet. The two sheets of inner film will be pulled apart to cause the air outlets 2*d* to be opened automatically when the two sheets of outer film are separated due to expansion because of the position of the hot sealing portion 2*c*, the air in the storage space flows out of the bag via the air outlets 2*d*, the air exhaust guide passages 2*e* and the exit portions 2*f* in sequence. If an article such as tea leaves is packed in the storage bag in bulk, few parts of the tea leaf tips will be passed through the air outlets 2*d* with air flow, and further blocked by the zigzag hot sealing line 13. thereby preventing the tea leaf tips from blocking the air exhaust guide passages 2*e* or the exit portion.

The special-shaped hot sealing points 17 are distributed randomly in an irregular pattern such as a mesh, but may also assume a regular distribution pattern. Each special-shaped hot sealing point 17 may be all kinds of shapes, such as a circle, ellipse, rectangle, triangle, rhombus, liner shape, cross shape, # shape and etc., but the present invention is not limited to these. The special-shaped hot sealing points may increase significantly the air locking effect.

Sixth Preferred Embodiment

FIGS. 11A, 11B, 12, 13, 14 and 15 show an air evacuable storage bag with multiple air exit holes of a sixth preferred embodiment according to the present invention.

A storage bag of the present invention further includes a hanging element 7, as a clothing article such as a coat or a suit must be stored by means of hanging. The hanging element 7 is a tough sheet of film formed by hot-sealing a folded plastic sheet, upper and lower sections of the sheet film are respectively manufactured into a thick and solid bending portion 71, a middle part thereof is a thinner sheet-shaped connection portion 72, in which the connection portion is used to connect with the two bending portions 71; a hot sealing point 7*c* has an adhesive fixing function and allow the hanging element 7 to assume an 8-typed body. Thus the upper bending portion 71 can be hooked on a circular hook in a wardrobe, the lower bending portion 71 placed in the storage space 11 may be placed in the storage space 11 to hook a circular hook, such as the circular hook of a clothes hanger.

Figure 12:
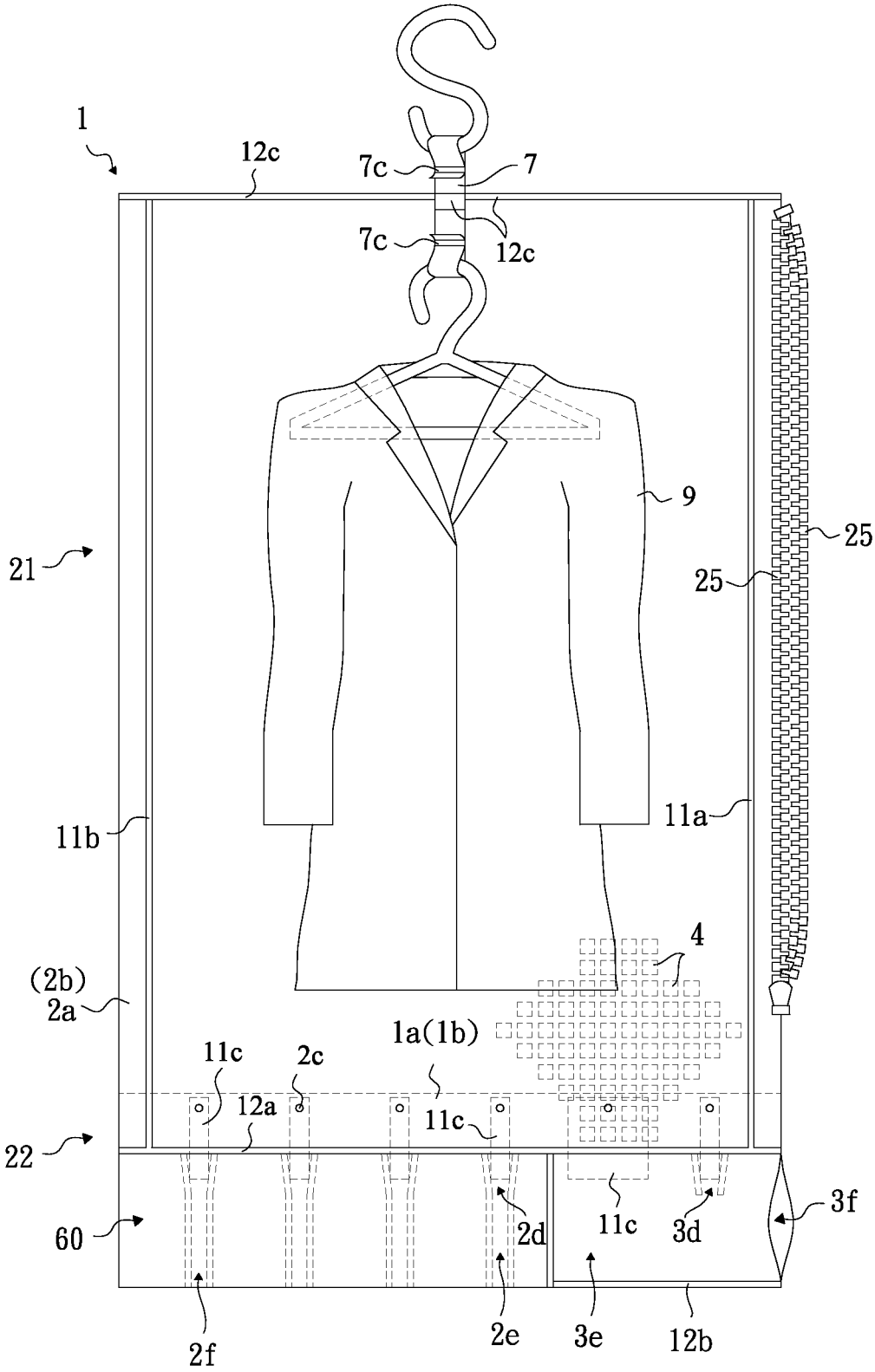
FIGS. 12 to 15 are plane views, showing a storage bag of the sixth embodiment according to the present invention.
Figure 13:
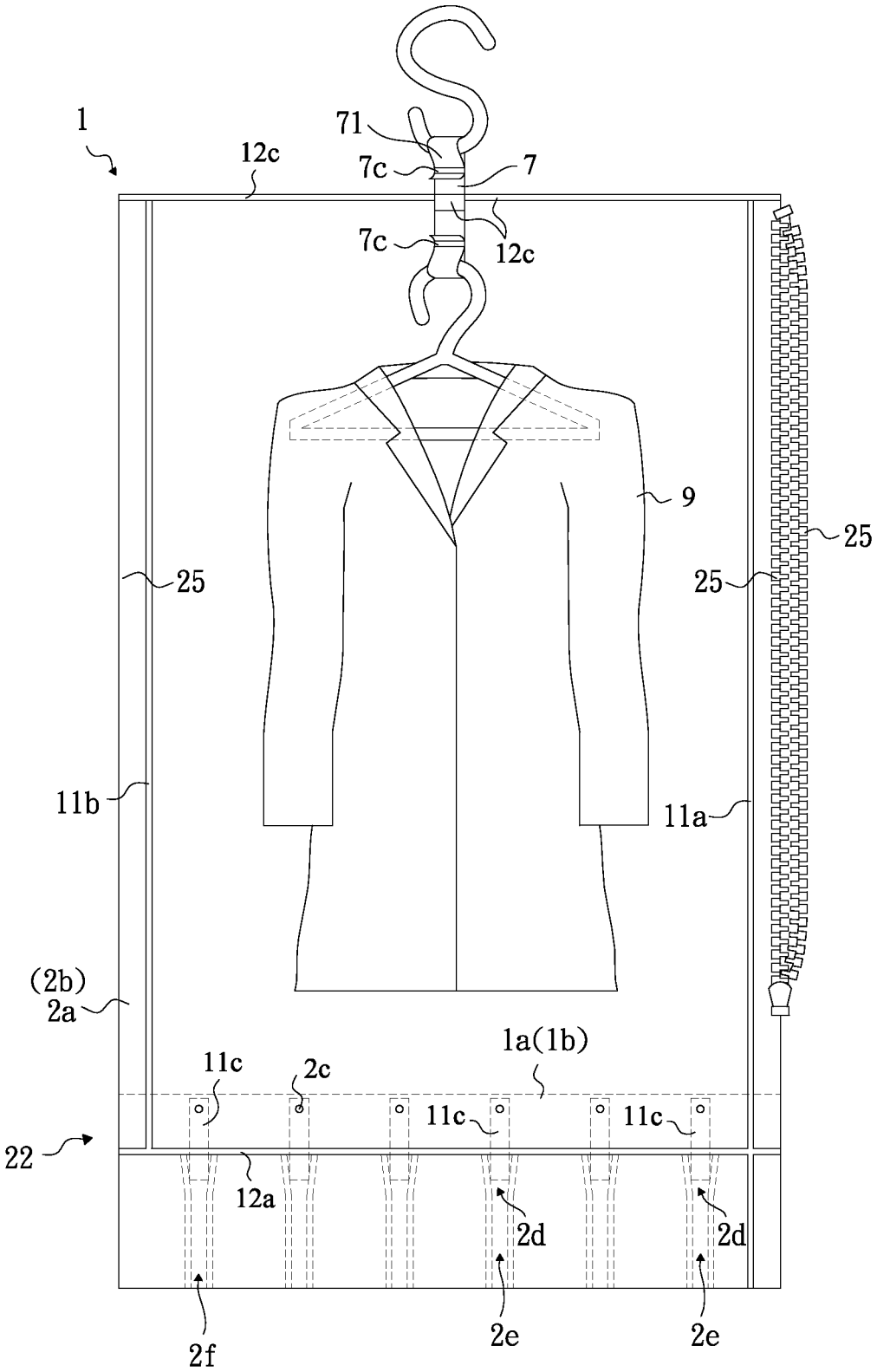

The hanging element 7 is positioned at the first end 21 of the two sheets of outer film, i.e. positioned at a middle part of the first end 21, a part of the hanging element is positioned between the two sheets of outer film, and other part thereof is positioned outside the storage bag as FIGS. 12 and 13 show.

Figure 14:
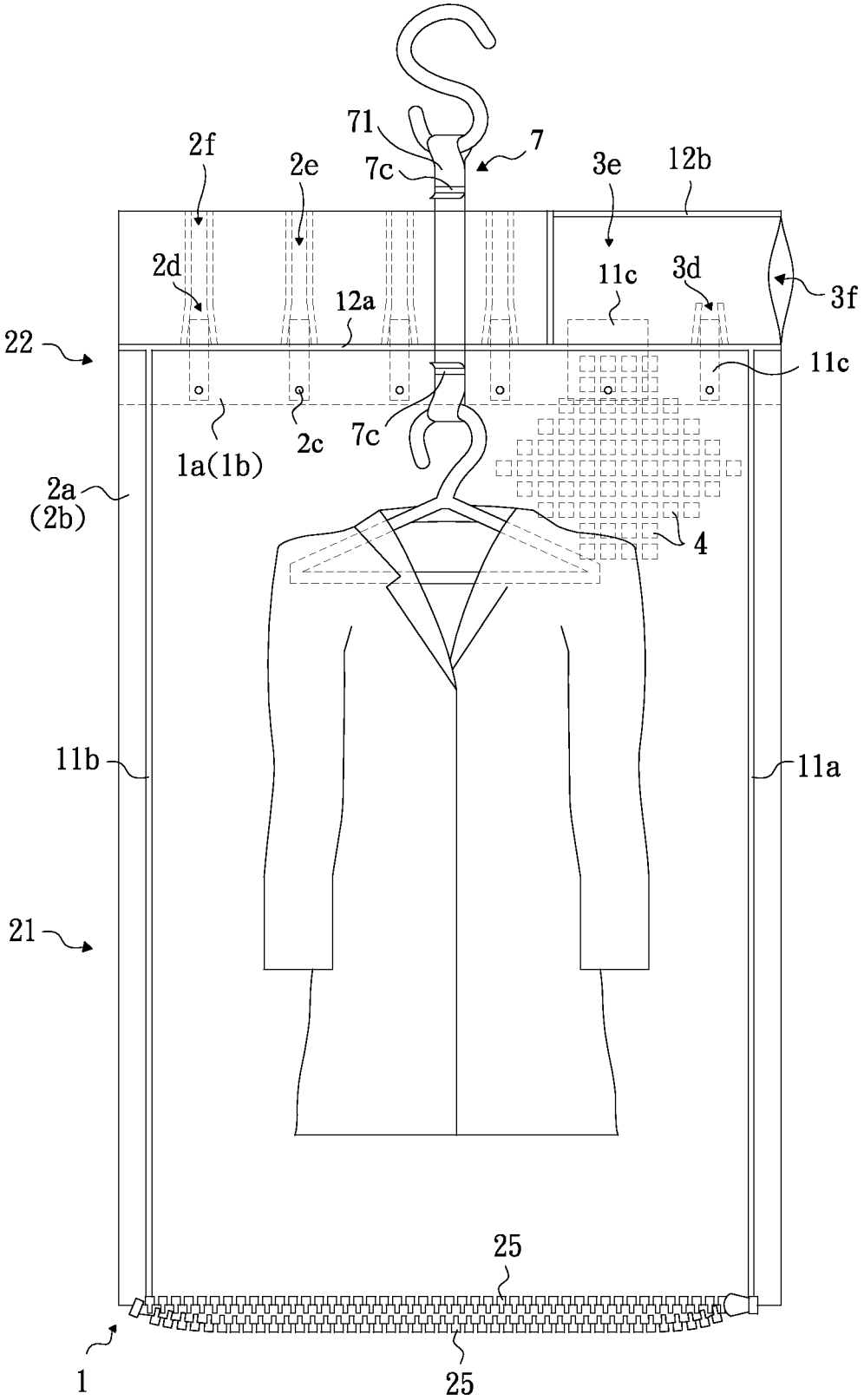
Figure 15:
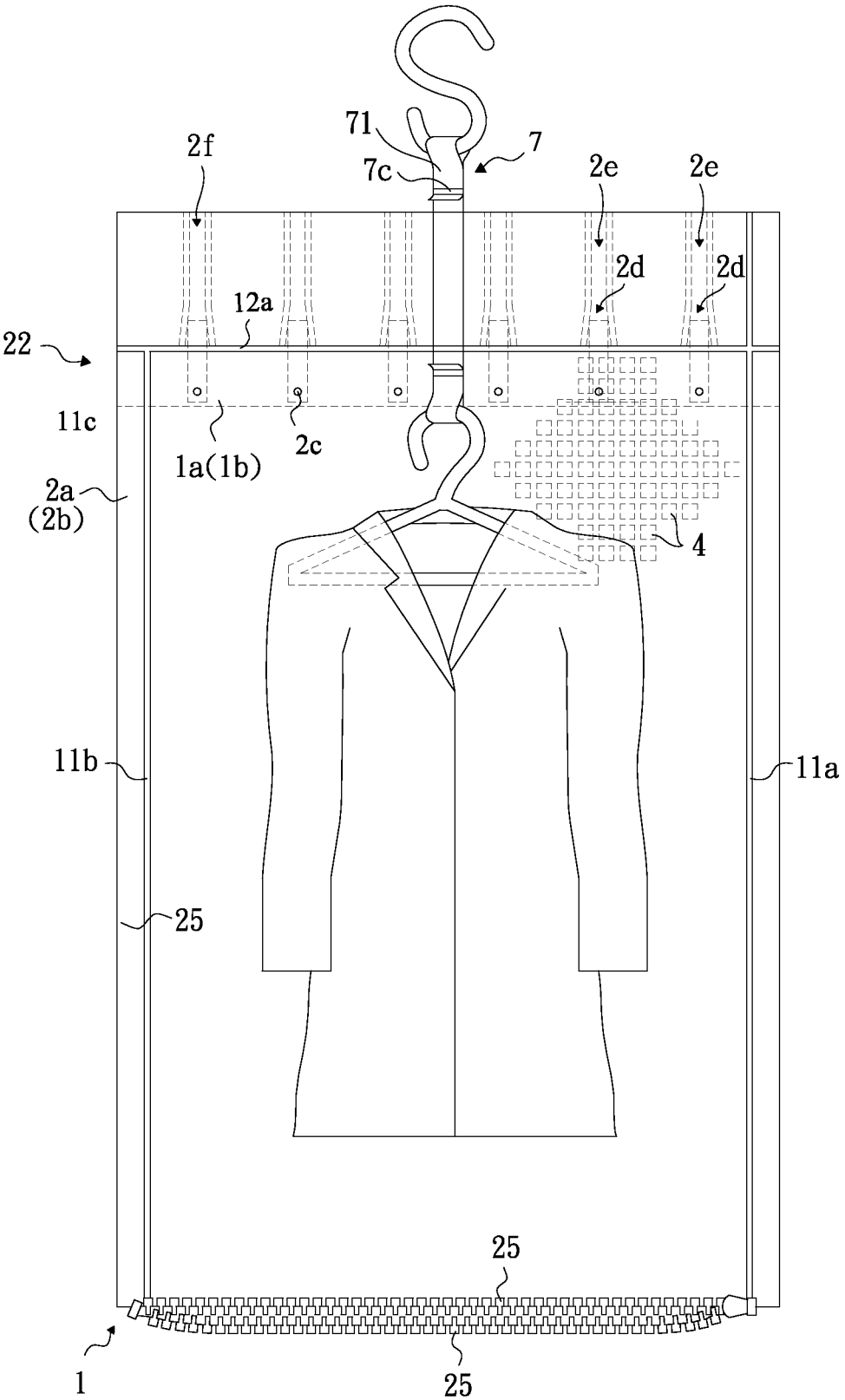

Otherwise, the hanging element may also be positioned in the air exhaust area 60, i.e. positioned in a middle part of the air exhaust area, a part of the upper bending portion 71 of the hanging element 7 is positioned outside the storage bag, a part of lower bending portion thereof is positioned in the storage space 11 and other part of the hanging element is positioned between the two sheets of inner film of the air exhaust as FIGS. 14 and 15 show. In the present embodiment, the close component 25 may be positioned on any side of the storage bag as FIGS. 12 and 13 show. If a user is unwilling to open and close the close component frequently, he may hot-seal sides of the storage bag directly after placing an article therein thereby allowing the storage space 11 to become a shielding space. Thereafter, he may roll and press the bag to enable air therein to be expelled.

In the present invention, the two sheets of inner film 1*a* and 1*b*, stacked together vertically, are placed in between the two sheets of outer film 2*a* and 2*b* stacked together vertically, one end of the two sheets of inner film is aligned with one end of the two sheets of outer film. The area including the two sheets of inner films between the two sheets of outer films is called an air exhaust area 60. Inner faces of the two sheets of inner film are spread with a plurality of strips of heat resistant material 11*c*, and a process is then carried out to the two sheets of outer film 2*a* and 2*b* as described above.

If a larger air outlet is needed, for example if the diameter of the air outlet 2*d* is larger than or equal to 2 cm, the crosswise hot sealing line 12*a* is then positioned on a bottom of the heat resistant material 11*c*, i.e. a place close to the hot sealing portion 2*c* such that the hot sealing portion 2*c* does not need to be positioned, because the diameter of the air outlet is large, it can be opened directly. Otherwise, an area of the heat resistant material is enlarged and a large or side hot sealing portion 2*c* is used accordingly If the diameter of the air outlet is small, an open-close device capable of pulling the two sheets of inner film apart at the same time that the two sheets of outer film are expanded is necessary to be positioned, the crosswise hot sealing line 12*a* is positioned at a place stretching over a middle section of the heat resistant materials 11*c*. Because inner faces of the two sheets of inner film are spread with the strips of heat resistant material 11*c* at the crosswise hot sealing line, the two sheets of inner film are not adhered to each other at places spread with the heat resistant material 11*c* to form a plurality of air outlets 2*d*. In addition, a plurality of hot sealing portions 2*c* are further formed by means of hot sealing at places close to the middle end 22 of the two sheets of outer film between the adjacent outer film and inner film, and each heat resistant material corresponds to at least one hot sealing portion 2*c*; the hot sealing portion 2*c* allows the two sheets of inner film to be respectively adhered to the adjacent outer film. Whereby, when the two sheets of outer film 2*a* and 2*b* are opened due to air expansion, the two sheets of inner film will be opened simultaneously, and each air outlet 2*d* between the two sheets of inner film is opened naturally to allow air to be expelled out from the air outlets 2*d*. Furthermore, the air exhaust guide passage 2*e* and exclusive air outlet 2*d* are formed by means of hot sealing at the air outlet 2*e*, and the air exhaust guide passages 2*e* are formed between the two sheets of inner film. A reverse attraction force will be created due to low air pressure in the storage space after the air in the storage space 11 is expelled to enable the two sheets of inner film in the air exhaust guide passages 2*e* to be attached to each other at the air outlets 2*d* and the air exhaust guide passages 2*e* to cause the two sheets of inner film to form a block in each air exhaust guide passage 2*e*, thereby preventing outside air entering the bag, forming a natural air lock.

An air exhaust method according to the present invention may use hands to roll an article to squeeze the air in the storage space 11, and may also use a tool to extract air. If an air extraction tool 8 is used to extract air, the air exhaust area 60 of the two sheets of inner film and the two sheets of outer film is then first carried out with hot sealing in advance to form the air extraction guide passage 3*e*, only the air extraction guide passage 3*f* is left to allow the air-extracting tool 8 to be inserted in to cause the air extraction guide passage 3*e* and the large air outlet 3*d* to be connected with each other as FIG. 12 shows. The air extraction guide passage 3*e* and the plurality of air exhaust guide passage 2*e* may exist simultaneously on the air exhaust area 60 of the same storage bag. As a mechanical extraction force is strong during the air extraction, it causes the two sheets of outer film 2*a* and 2*b* to influence the exhaust of air of the other areas in the storage space 11 due to the adhesion caused from the attraction force. Therefore, a plurality of projecting raised portions 4 are positioned in advance on the largest heat resistant material 11*c* and an area below the largest heat resistant material in the storage space 11; the raised portions 4 are distributed between the two sheets of outer film. Thus, the raised portions are positioned between the two sheets of outer film 2*a* and 2*b* in the storage space 11 to form the gaps 111, the air in the storage space 11 can still be passed through the air outlets 3*d*, and especially passed through the largest air outlet to extract out smoothly thereby reducing a volume of the storage bag.

Furthermore, the structure of an air-evacuable storage bag with multiple air exit holes is simple, can be manufactured easily and is suitable for a batch production.

Additional advantages and modifications will readily occur to those skilled in the relevant fields. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An air-evacuable storage bag with multiple air exit holes comprising:

two outer film sheets, comprising a first end, a middle end and a top end;

two inner film sheets, disposed between the two outer film sheets, and positioned between the top end and the middle end of the two outer film sheets;

a crosswise hot sealing line, formed by hot-sealing the two outer film sheets and the two inner film sheets;

a storage space, formed between the crosswise hot sealing line and the first end and having two inner surfaces respectively defined by the two outer film sheets;

a plurality of hot sealing portions, positioned at the inner surfaces of the storage space close to the middle end of the two outer film sheets, such that one of the two outer film sheets is adhered, at each of the hot sealing portions, to one of the two inner film sheets that is adjacent to the one of the two outer film sheets;

an air exhaust area, formed between the crosswise hot sealing line and the top end of the two outer film sheets including:

a plurality of air exhaust guide passages disposed between the two inner film sheets, one end of each of the respective plurality of air exhaust guide passages being connected to an exit portion; and a plurality of air outlets, positioned intermittently between the two inner film sheets and positioned at the crosswise hot sealing line to connect the storage space and the air exhaust guide passages;

a plurality of special-shaped hot sealing points distributed in the air exhaust area, each special-shaped point being formed by one of adhering the two inner film sheets to each other by means of hot sealing and adhering the two inner film sheets and the two outer film sheets to each other by means of hot sealing, the plurality of air exhaust guide passages being formed among the plurality of special-shaped hot sealing points; and a plurality of strips of heat resistant material spread on inner sides of the two inner film sheets and between the two inner film sheets, the crosswise hot sealing line being stretched over each strip of the heat resistant material, the air outlets being formed at the strips of the heat resistant material between the two inner film sheets, wherein a top end of the air exhaust area and one end thereof are adhered by means of hot sealing to form an air extraction guide passage, one side of the air extraction guide passage comprising an exit portion, each air outlet is connected with the air extraction guide passage, the hot sealing portions and the crosswise hot sealing line form an automatic open-close device, and each strip of the heat resistant material corresponds to at least one of the hot sealing portions;

wherein air in the storage space is squeezed toward the middle end and causes said two outer film sheets to be pushed apart, so that said two outer film sheets respectively pull said two inner film sheets apart by the hot sealing portions to open said air outlets and to allow air in the storage space to flow out of the bag from the air outlets and then along the air exhaust guide passages.

2. The air-evacuable storage bag with multiple air exit holes according to claim 1, wherein a distribution of the special-shaped hot sealing points in the air exhaust area is one of a randomly irregular distribution and a regular distribution.

3. The air-evacuable storage bag with multiple air exit holes according to claim 1, wherein each special-shaped hot sealing point is one of a circle, ellipse, rectangle, square, triangle, rhombus, linear body, cross-typed body, #-shaped body and a combination thereof, and the special-shaped hot sealing points assume a meshed distribution.

4. The air-evacuable storage bag with multiple air exit holes according to claim 1, wherein a plurality of opposite raised portions are respectively positioned on inner faces of the two outer film sheets in the storage space, two opposite groups of the raised portions being attached to each other during air exhaust, gaps being formed among the raised portions, an area of at least one strip of the heat resistant material is larger than any other strip of the heat resistant material, and the at least one largest strip of the heat resistant material corresponds to a largest of the air outlets.

5. The air-evacuable storage bag with multiple air exit holes according to claim 4, wherein the plurality of raised portions are positioned with the at least one largest strip of the heat resistant material.

6. The air-evacuable storage bag with multiple air exit holes according to claim 4, wherein the plurality of raised portions are positioned between a middle part of the storage space and the crosswise hot sealing line.

* * * * *